US007792468B2

(12) United States Patent
Ichikawa et al.

(10) Patent No.: US 7,792,468 B2
(45) Date of Patent: Sep. 7, 2010

(54) DEVELOPER STORAGE CONTAINER AND IMAGE FORMING APPARATUS USING THE SAME

(75) Inventors: Hideo Ichikawa, Ebina (JP); Hirokazu Murase, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 190 days.

(21) Appl. No.: 12/121,851

(22) Filed: May 16, 2008

(65) Prior Publication Data

US 2009/0129827 A1 May 21, 2009

(30) Foreign Application Priority Data

Nov. 18, 2007 (JP) ..... 2007-298742

(51) Int. Cl.
*G03G 15/08* (2006.01)

(52) U.S. Cl. ..... 399/262

(58) Field of Classification Search ..... 399/120, 399/258, 262; 222/169, 172, DIG. 1
See application file for complete search history.

(56) References Cited

U.S. PATENT DOCUMENTS

| | | | | |
|---|---|---|---|---|
| 5,933,691 | A | 8/1999 | Johroku | |
| 6,292,644 | B1 | 9/2001 | Goto et al. | |
| 2009/0238608 | A1 * | 9/2009 | Murase et al. | 399/262 |

FOREIGN PATENT DOCUMENTS

| | | | | |
|---|---|---|---|---|
| JP | 9-281784 | A | | 10/1997 |
| JP | 10-142915 | A | | 5/1998 |
| JP | 2000-162861 | A | | 6/2000 |
| JP | 2005-31229 | A | | 2/2005 |
| JP | 2005107141 | A | * | 4/2005 |
| JP | 2006-145873 | A | | 6/2006 |

OTHER PUBLICATIONS

Japanese Office Action dated Jul. 16, 2008.
U.S. Appl. No. 12/566,349, filed Sep. 24, 2009; inventors: Hideo Ichikawa, et al; Assignee: Fuji Xerox Co., Ltd.

* cited by examiner

*Primary Examiner*—Robert Beatty
(74) *Attorney, Agent, or Firm*—Sughrue Mion, PLLC

(57) ABSTRACT

A developer storage container includes a container body, an opening formed in the container body, an opening-and-closing cover, a cover holding frame that holds the cover so that the cover is movable between opening and closing positions, a protrusion portion, a blocking portion and a position regulating protrusion. When the opening-and-closing cover moves in the opening-and-closing direction toward the opening position and reaches a certain intermediate position, the blocking portion contacts with the protrusion portion. When the opening-and-closing cover moves from a position where the protrusion portion and the blocking portion are in contact with each other to the closing position, the position regulating protrusion causes the opening-and-closing cover to move in a intersecting direction and regulates a position of the opening-and-closing cover in the intersecting direction so that the blocking portion is overlapped, along the opening-and-closing direction, with the position of the distal end of the protrusion portion.

5 Claims, 30 Drawing Sheets

DEVELOPER STORAGE CONTAINER AND IMAGE FORMING APPARATUS USING THE SAME

CROSS-REFERENCE TO RELATED APPLICATIONS

This application is based on and claims priority under 35 USC 119 from Japanese Patent Application No. 2007-298742 filed Nov. 18, 2007.

BACKGROUND

Technical Field

The invention relates to a developer storage container and an image forming apparatus using the same.

SUMMARY

According to an aspect of the invention, a developer storage container is removably inserted into a container receiving portion of a chassis of an image forming apparatus. The container stores a developer therein. The container includes a container body that stores the developer therein, an opening formed in a portion of the container body, an opening-and-closing cover, a cover holding frame, a protrusion portion, a blocking portion and a position regulating protrusion. The opening-and-closing cover is configured to block the opening. The cover holding frame holds the opening-and-closing cover so that the opening-and-closing cover is movable in an opening-and-closing direction between an opening position in which the opening is open and a closing position in which the opening is closed. The protrusion portion is formed in the opening-and-closing cover. The protrusion portion protrudes toward the cover holding frame when the opening-and-closing cover is located in the closing position. The blocking portion is provided on the cover holding frame. The blocking portion is disposed in a position that is overlapped, along the opening-and-closing direction of the opening-and-closing cover, with a position of a distal end of the protrusion portion when the opening-and-closing cover is located in the closing position. When the opening-and-closing cover moves in the opening-and-closing direction from the closing position toward the opening position and reaches a certain intermediate position in which it is not started to open the opening, the blocking portion is in contact with the protrusion portion and is blocked. The position regulating protrusion is provided in the cover holding frame. When the opening-and-closing cover moves from a position where the protrusion portion and the blocking portion are in contact with each other to the closing position, the position regulating protrusion causes the opening-and-closing cover to move in a direction intersecting the opening-and-closing direction and regulates a position of the opening-and-closing cover in the direction intersecting the opening-and-closing direction so that the blocking portion is overlapped, along the opening-and-closing direction, with the position of the distal end of the protrusion portion.

BRIEF DESCRIPTION OF THE DRAWINGS

Exemplary embodiment(s) of the present invention will be described in detail based on the following figures, wherein.

DETAILED DESCRIPTION

Outline of Exemplary Embodiment of the Invention

Figure 1A:
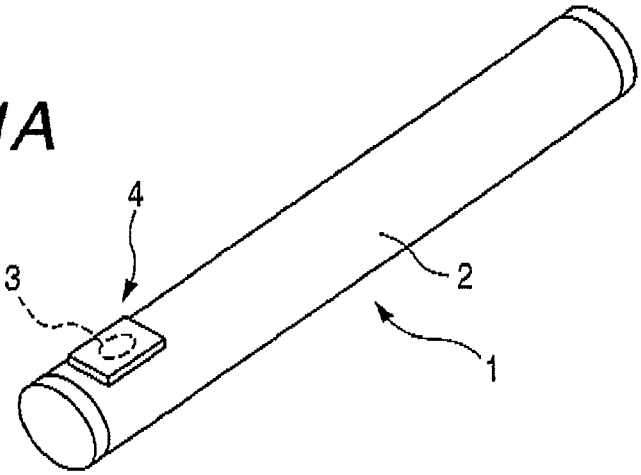
FIG. 1A is an explanatory diagram showing an outline of a developer storage container according to an exemplary embodiment of the invention.

FIG. 1A shows an outline of a developer storage container according to an exemplary embodiment of the invention.

A developer storage container 1 shown in FIG. 1 is configured so that the developer storage container is removably inserted into a container receiving portion of a chassis of an image forming apparatus and stores a developer therein. The developer storage container 1 includes a container body 2 that stores the developer therein, an opening 3 formed in a portion of the container body 2, and an opening-and-closing mechanism 4 that opens and closes the opening 3.

Figure 1B:
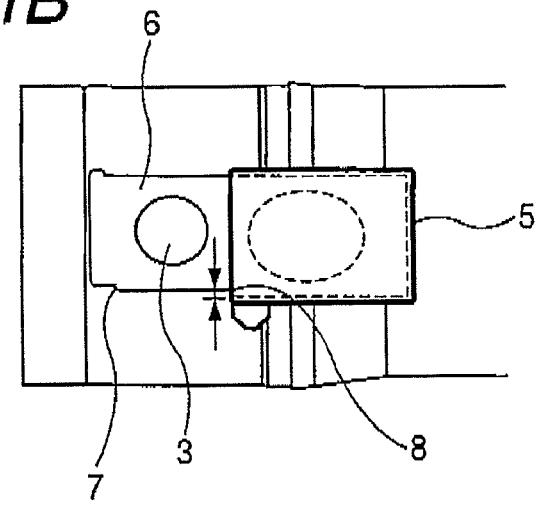
FIG. 1B is an explanatory diagram showing an opening-and-closing mechanism of the developer storage container.
Figure 1C:
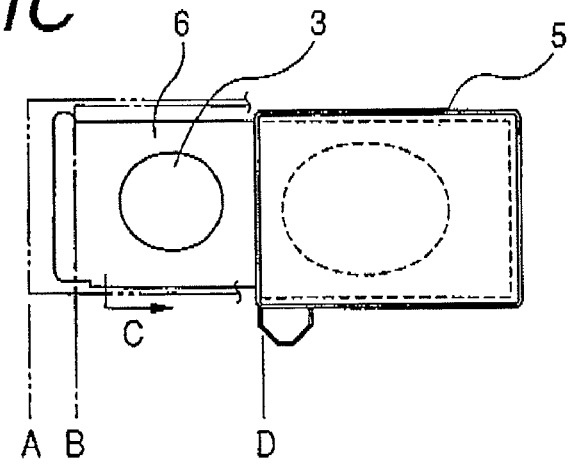
FIG. 1C is an explanatory diagram showing an opening/closing operation of the opening-and-closing mechanism.

In particular, in this exemplary embodiment, as shown in FIGS. 1B and 1C, the opening-and-closing mechanism 4 includes an opening-and-closing cover 5 that blocks the opening 3, a cover holding frame 6, a movement restricting unit 7 and a restriction releasing unit 8. The cover holding frame 6 holds the opening-and-closing cover 5 so that the opening-and-closing cover 5 is movable in an opening-and-closing direction between an opening position D in which the opening 3 is open and a closing position A in which the opening 3 is closed. When the opening-and-closing cover 5 moves in the opening-and-closing direction from the closing position A toward the opening position D and reaches a certain intermediate position B in which it is not started to open the opening 3, the movement restricting unit 7 restricts the opening-and-closing cover 5 from further moving in the opening-and-closing direction. The restriction releasing unit 8 allows the opening-and-closing cover 5 being restricted by the movement restricting unit 7 to be movable in an intersecting direction which intersects the opening-and-closing direction. After the opening-and-closing cover 5 moves in the intersecting direction, the restriction releasing unit 8 allows the opening-and-closing cover 5 to move in the opening-and-closing direction toward the opening position D.

In this configuration, the developer storage container 1 may store therein an unused developer and/or may recover and store therein a used developer.

The container body 2 may be appropriately shaped so long as it can store the developer therein, instead of this exemplary embodiment in which the container body 2 extends long in an insertion/removal direction.

Furthermore, in order to avoid the developer stored in the container body 2 from forming local agglomerates due to change in environment or change with aging, the container body 2 may include a stirring member that can be driven by an external driving source. When the container body 2 includes the stirring member or the like, the container body 2 may be a cylindrical container having at least one open end and an end cover member that blocks the end opening.

The cover holding frame 6 may be separately or integrally provided in the vicinity of the opening 3 of the container body 2 in a position where it can hold the opening-and-closing cover 5 in an openable/closable manner between the opening position D and the closing position A of the opening 3. In this case, the cover holding frame 6 may be provided to surround the periphery of the opening 3 or may be provided only in a peripheral portion of the periphery of the opening 3 extending in the opening-and-closing direction of the opening-and-closing cover 5.

A movement restriction position in which the movement restricting unit 7 restricts the opening-and-closing cover 5 from further moving in the opening-and-closing direction is the certain intermediate position B that is closer to the closing position A than a position in which the opening-and-closing cover 5 starts to open the opening 3. With this configuration, even if it is attempted to move the opening-and-closing cover 5 in the opening direction with respect to the container body 2, the opening-and-closing cover 5 is restricted by the movement restricting unit 7 from moving in the opening direction before the opening 3 starts to be open. Thus, the opening-and-closing cover 5 does not start to open the opening 3. For example, when the developer storage container 1 is dropped or when an external force is applied in the opening direction to the opening-and-closing cover 5 during transport, the opening-and-closing cover does not immediately open the opening 3. As a result, the event that the developer leaks through the opening 3 is effectively prevented.

It is noted that the closing position A is not identical to the intermediate position B. If they are identical, to perform an opening/closing operation for the opening-and-closing cover 5, it would be necessary to perform two operations as the opening/closing operation, that is, first, the opening-and-closing cover 5 is moved in a direction different from the opening-and-closing direction and then moved in the opening-and-closing direction, which may complicate the opening/closing operation.

Also, any member may be used as the restriction releasing unit 8 so long as it can perform a function of moving the opening-and-closing cover 5 in the intersecting direction intersecting the opening-and-closing direction so that the state in which the movement restricting unit 7 restricts the opening-and-closing cover 5 is released.

The opening-and-closing direction of the opening-and-closing cover 5 may be appropriately set to a direction different from the insertion/removal direction of the developer storage container 1. For example, when the insertion/removal direction of the developer storage container 1 is set to a direction along which the developer storage container 1 moves linearly, the opening-and-closing direction may be set to a direction along which the developer storage container 1 rotates. From the view point of simplifying the opening/closing operation of the opening-and-closing cover 5, the opening-and-closing direction of the opening-and-closing cover 5 of the opening-and-closing mechanism 4 may be set to extend along the insertion/removal direction of the developer storage container 1.

The movement restricting unit 7 may be appropriately constructed. According to one exemplary embodiment, the movement restricting unit 7 includes a blocking portion provided on the cover holding frame 6. When the opening-and-closing cover 5 moves in the opening-and-closing direction from the closing position A toward the opening position D, the blocking portion may abut against a portion of the opening-and-closing cover 5. In this case, the blocking portion may be provided on a portion of the cover holding frame 6 go as to blocks movement of the opening-and-closing cover 5, and a stopper portion may be provided on the opening-and-closing cover 5 so as to abut against the blocking portion.

The restriction releasing unit 8 may release the state in which the movement restricting unit 7 restricts the opening-and-closing cover 5. According to one exemplary embodiment, when the opening-and-closing cover 5 moves a predetermined amount in the direction intersecting the opening-and-closing direction, the restriction releasing unit 8 releases the restriction state in which the movement restricting unit 7 restricts the opening-and-closing cover 5. As a typical example of this exemplary embodiment, the opening-and-closing cover 5 is held by the cover holding frame 6 so that the opening-and-closing cover 5 restricted by the movement restricting unit 7 is movable in the intersecting direction, which intersects the opening-and-closing direction, and the amount of movement of the opening-and-closing cover 5 in the intersecting direction is set within such a range that the state in which the movement restricting unit 7 restricts the opening-and-closing cover 5 can be released.

Further, in order to restrict the movement of the opening-and-closing cover 5 in the intersecting direction, a position regulating protrusion may be provided on the cover holding frame 6. The position regulating protrusion regulates a position of the opening-and-closing cover 5 in the intersecting direction. In this case, according to one exemplary embodiment, the restriction releasing unit 8 is configured so that a dimension by which the position regulating protrusion protrudes from a reference position of the cover holding frame 6 is larger than a minimum dimension of the restricting releasing unit 8 in the intersecting direction, which can release a state in which the movement restricting unit 7 restricts the opening-and-closing cover 5.

Figure 2:
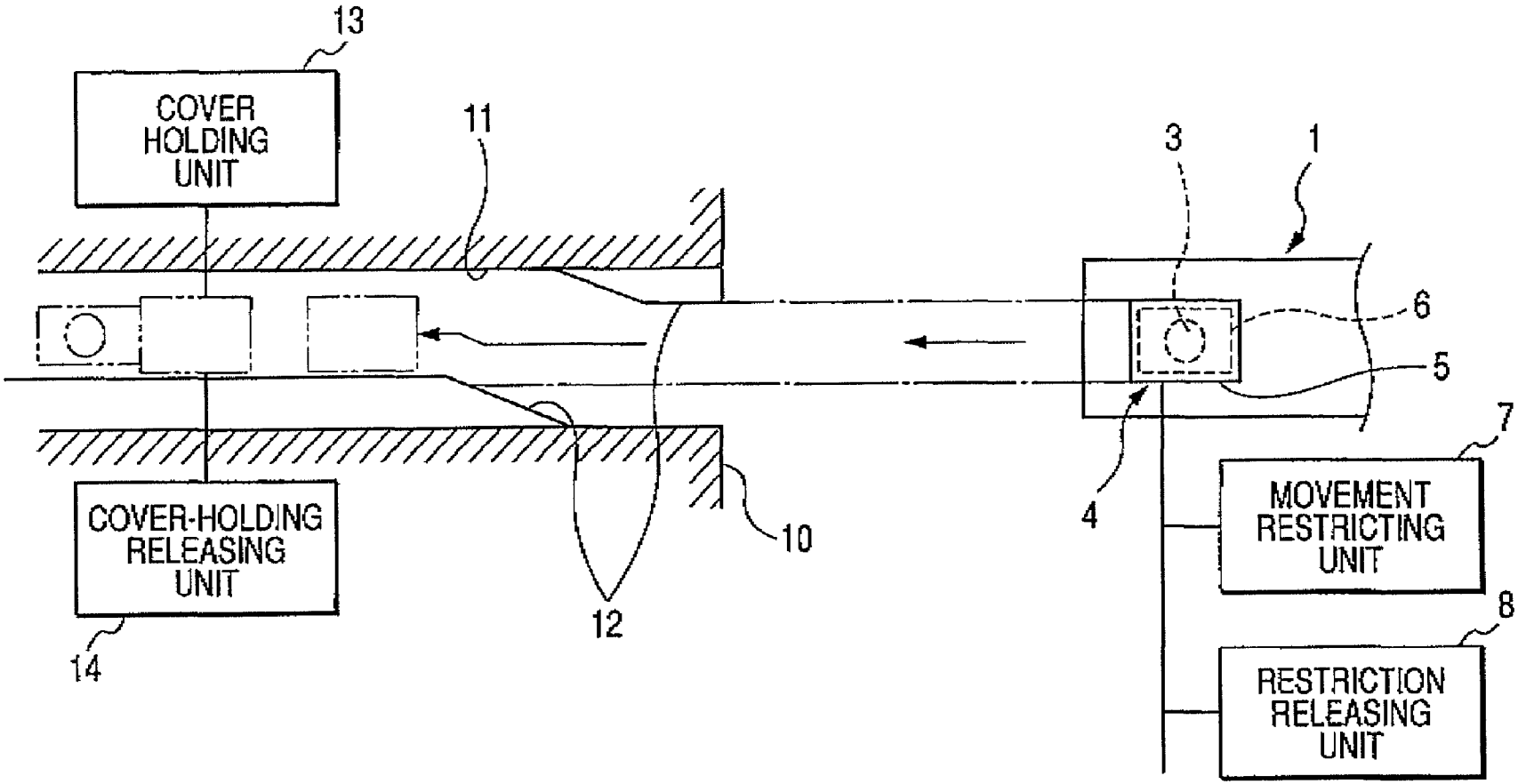
FIG. 2 is an explanatory diagram showing an outline of an image forming apparatus using the developer storage container according to the exemplary embodiment shown in FIG. 1.

FIG. 2 shows an example in which an image forming apparatus includes the developer storage container 1 according to the exemplary embodiments described above.

In this figure, the image forming apparatus includes a chassis 10 formed with a container receiving portion 11, and the developer storage container 1 configured to be removably inserted into the container receiving portion 11 of the chassis 10. The developer storage container 1 stores the developer therein.

Here, the developer storage container 1 includes the container body 2 (see FIG. 1) that stores the developer therein, the opening 3 formed in a portion of the container body 2, and the opening-and-closing mechanism 4 that opens and closes the opening 3. The opening-and-closing mechanism 4 includes the opening-and-closing cover 5, the cover holding frame 6, the movement restricting unit 7 and the restriction releasing unit 8. The opening-and-closing cover 5 blocks the opening 3. The cover holding frame 6 holds the opening-and-closing cover 5 so that the opening-and-closing cover 5 is movable in the opening-and-closing direction between the opening position D in which the opening 3 is open and the closing position A in which the opening 3 is closed. When the opening-and-closing cover 5 moves in the opening-and-closing direction from the closing position A to the opening position D and reaches the intermediate position B in which it is not started to open the opening 3, the movement restricting unit 7 restricts the opening-and-closing cover 5, from further moving in the opening-and-closing direction. The restriction releasing unit 8 allows the opening-and-closing cover 5 being restricted by the movement restricting unit 7 to be movable in the intersecting direction intersecting the opening-and-closing direction. After the opening-and-closing cover 5 moves in the intersecting direction, the restriction releasing unit 8 allows the opening-and-closing cover 5 to move in the opening-and-closing direction toward the opening position D.

Meanwhile, the container receiving portion 11 of the chassis 10 of the image forming apparatus includes a cover guide rail 12 that guides a movement locus of the opening-and-closing cover 5 of the developer storage container 1, a cover holding unit 13, and a cover-holding releasing unit 14. When the developer storage container 1 is being inserted, the cover holding unit 13 abuts against the opening-and-closing cover 5 to move the opening-and-closing cover 5 toward the opening position D and then holds the opening-and-closing cover 5. When the developer storage container 1 is being removed, the cover holding unit moves the opening-and-closing cover 5, which is located in the opening position D, toward the closing position A. When the developer storage container 1 is being removed and the opening-and-closing cover 5 reaches the closing position A, the cover-holding releasing unit 14 releases a state in which the cover holding unit 13 holds the opening-and-closing cover 5.

In this configuration, respective components of the developer storage container 1 are similar to those, which are described with reference to FIG. 1.

The container receiving portion 11 includes the cover guide rail 12, the cover holding unit 13, and the cover-holding releasing unit 14.

The cover guide rail 12 may be a continuous rail member or may be one that embodies a rail function that guides the opening-and-closing cover 5 using a wall member or a guide block member.

It is assumed that the developer storage container 1 includes the movement restricting unit 7 and the restriction releasing unit 8. The cover guide rail 12 may guide the movement locus of the opening-and-closing cover 5 by the units 7 and 8.

For example, since the restriction releasing unit 8 is configured so that the opening-and-closing cover 5 is movable in the intersecting direction, which intersects the opening-and-closing direction, the cover guide rail 12 may be configured appropriately so long as the cover guide rail 12 can guide, in the movement restriction position, the opening-and-closing cover 5 to move in the intersecting direction beyond the movement restriction position.

Also, any member may be used as the cover holding unit 13 so long as it can perform a function of moving the opening-and-closing cover 5 to the opening position D when the developer storage container 1 is being inserted, so as to hold the opening-and-closing cover 5 there and moving the opening-and-closing cover 5 from the opening position D to the closing position A when the developer storage container 1 is being removed.

Furthermore, any member may be used as the cover-holding releasing unit 14 so long as it can perform a function of releasing the state in which the cover holding unit 13 holds the opening-and-closing cover 5 when the developer storage container 1 is being removed.

According to one exemplary embodiment, the cover holding unit 13 includes an elastic holding part that extends in the opening-and-closing direction of the opening-and-closing cover 5 and is elastically deformable. When the developer storage container 1 is being inserted, the elastic holding part abuts against the opening-and-closing cover 5 to move the opening-and-closing cover 5 to the opening position D and the elastic holding part is elastically deformed outward at a time point when the opening-and-closing cover 5 reaches the opening position D, so as to be displaced from the opening-and-closing cover 5 and then hold the opening-and-closing cover 5 being located in the opening position D.

According to another exemplary embodiment in which the cover holding unit 13 is employed, the cover-holding releasing unit 14 includes a holding releasing protruding part that is elastically deformed in the direction for displacing the elastic holding part from the opening-and-closing cover 5 when the opening-and-closing cover 5 reaches the closing position A. The holding releasing protruding part releases the state in which the elastic holding part holds the opening-and-closing cover 5.

Hereinafter, exemplary embodiments of the invention will be described in detail with reference to the attached drawings.

Exemplary Embodiment 1

Overall Configuration of Image Forming Apparatus

Figure 3:
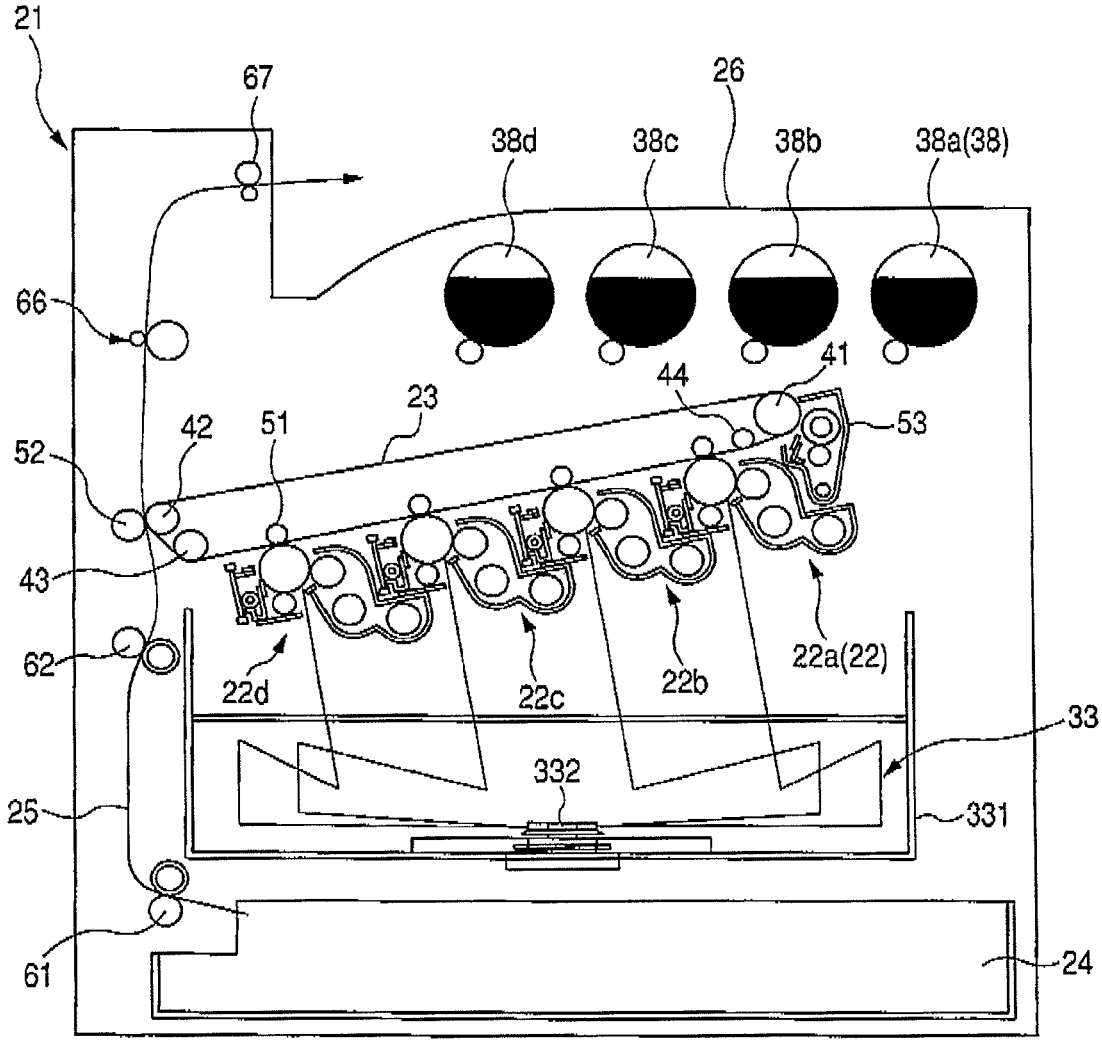
FIG. 3 is an explanatory diagram showing an overall configuration of the image forming apparatus according to a first exemplary embodiment of the invention.

FIG. 3 shows an overall configuration of an image forming apparatus according to a first exemplary embodiment of the invention.

In this figure, in a chassis 21 of the image forming apparatus (hereinafter, simply a chassis or an apparatus chassis), the image forming apparatus includes image forming portions 22 (specifically, 22*a* to 22*d*) for respective four colors (in this exemplary embodiment, black, yellow, magenta, and cyan) arranged in an obliquely upward direction; an intermediate transfer belt 23 that is arranged above the image forming portions 22 and rotate along the arrangement direction of the image forming portions 22; a recording-medium supply unit 24 that is arranged in a lower portion of the apparatus chassis 21 and stores and supplies recording media; and a recording-medium discharge tray 26 that is arranged in an upper portion of the apparatus chassis 21 and receives and stores discharged recording media on which images are formed. The recording medium supplied from the recording-medium supply unit 24 is discharged to the recording-medium discharge tray 26 through a recording-medium conveyance path 25 that extends in a vertical direction.

Figure 4:
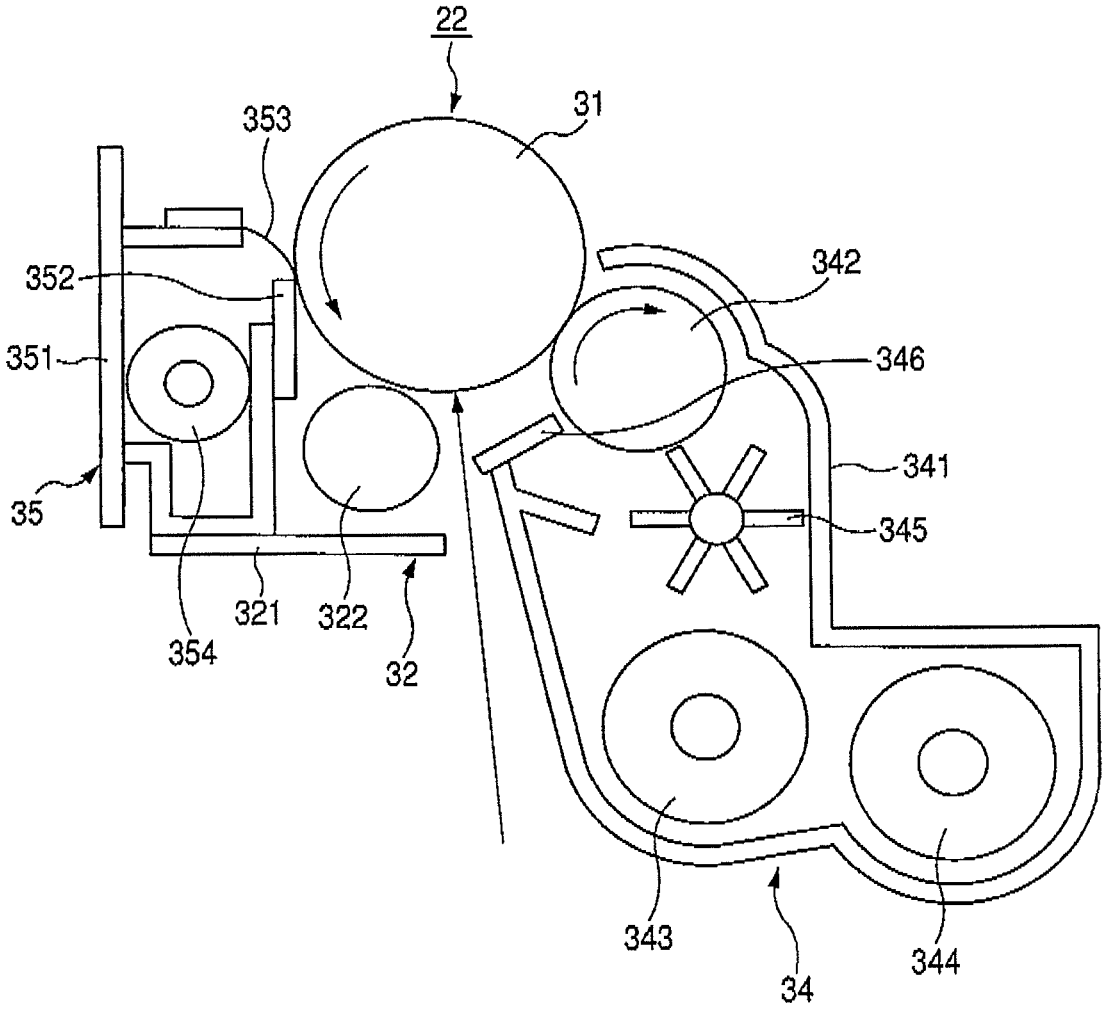
FIG. 4 is an explanatory diagram showing details of an image forming portion of the image forming apparatus shown in FIG. 3.

In this exemplary embodiment, as shown in FIGS. 3 and 4, the image forming portions 22 (22*a* to 22*d*) are configured to form, in order from the upstream side in the rotation direction of the intermediate transfer belt 23, toner images, for example, of black, yellow, magenta, and cyan (however, it is not necessary to arrange the colors in this order). Each image forming portion 22 includes a drum-shaped photosensitive member 31, a charging unit 32 that preliminarily charges the photosensitive member 31, an exposure unit 33 that forms an electrostatic latent image on the photosensitive member 31 charged by the charging unit 32, a developing unit 34 that develops the electrostatic latent image on the photosensitive member 31 into a visible image using a toner of the corresponding color, and a cleaning unit 35 that cleans a residual toner on the photosensitive member 31.

The exposure unit 33 is provided in common to the respective image forming portions 22 and is configured to deflect and scan light beams for the respective color components from a light source such as a semiconductor laser (not shown) within an exposure container 331 using a deflection mirror 332, thereby forming a light image in an exposure position on the corresponding photosensitive member 31 via a focusing lens (not shown) and mirrors (not shown).

The intermediate transfer belt 23 is wound around plural tension rollers 41 to 44 and is rotated, for example, by a tension roller 41 serving as a driving roller. On portions of the rear surface of the intermediate transfer belt 23, which correspond to the respective photosensitive members 31, primary transfer units 51 (for example, primary transfer rollers) are arranged. Voltage having a polarity opposite to the polarity charged to toner is applied to the primary transfer units 51. Thereby, the toner images formed on the photosensitive members 31 are electrostatically transferred onto the intermediate transfer belt 23.

Furthermore, a secondary transfer unit 52 (for example, a secondary transfer roller) is provided in a portion corresponding to the tension roller 42 on the downstream side of the image forming portion 22*d* disposed on the most-downstream side of the intermediate transfer belt 23. By the secondary transfer unit 52, the toner images primarily transferred onto the intermediate transfer belt 23 are secondarily transferred (collectively transferred) onto the recording medium.

Furthermore, an intermediate cleaning unit 53 for cleaning a residual toner on the intermediate transfer belt 23 is provided in a portion corresponding to the tension roller 41 on the downstream side of the second transfer portion of the intermediate transfer belt 23.

The intermediate transfer belt 23 is made by blending a rubber or a resin such as polyimide, polycarbonate, polyester, or polypropylene with an antistatic agent such as carbon black in appropriate proportions to a volume resistivity of $10^6$ to $10^{14}$ Ω·cm.

In this exemplary embodiment, the recording medium fed by a feeder 61 of the recording-medium supply unit 24 is conveyed to an appropriate number of conveyance rollers (not shown) in the recording-medium conveyance path 25 and passed through the secondary transfer portion of the secondary transfer unit 52 with the position being aligned at position alignment rollers 62. Then, non-fixed toner images on the recording medium are fixed by a fixing unit 66 by means of heat and pressure and discharged and stored to the recording-medium discharge tray 26 via a discharge roller 67.

In FIG. 3, reference numeral 38 (38*a* to 38*d*) denotes developer storage containers that replenish the developing units 34 of the respective image forming portions 22 (22*a* to 22*d*) with new developer (in this exemplary embodiment, toner).

<Image Forming Portion>

In particular, in this exemplary embodiment, as shown in FIG. 4, the photosensitive member 31 is configured as a process cartridge that is integrated with the charging unit 32 and the cleaning unit 35. The process cartridge is detachably attached to the apparatus chassis 21 and constitutes portions of the image forming portions 22 of each color component.

Here, the charging unit 32 includes a charging chamber 321 that is open to a portion opposite the photosensitive member 31, and a charging roller 322 is disposed in the charging chamber 321 so as to contact or approach the surface of the photosensitive member 31.

The cleaning unit 35 includes a cleaning chamber 351 that is open to a portion opposite the photosensitive member 31. At one end of the opening in the longitudinal direction of the cleaning chamber 351, a cleaning blade 352 formed of an elastic scraping plate is provided so as to contact the photosensitive member 31. At the other end of the opening in the longitudinal direction of the cleaning chamber 351, an elastic sealing member 353 is provided so as to contact the photosensitive member 31. Within the cleaning chamber 351, a leveling and conveying member 354 is provided for leveling and conveying residual materials such as toner scraped by the cleaning blade 352 in the longitudinal direction.

In addition, in this exemplary embodiment, the developing unit 34 is attached to the apparatus chassis 21 in a separate manner from the process cartridge and includes a developing chamber 341 that is open opposite the photosensitive member 31 and stores therein developer containing at least toner. In the vicinity of the opening of the developing chamber 341, a developer carrier 342 is provided capable of conveying developer toward a developing zone located at a portion opposite the photosensitive member 31. On the rear surface side of the developing chamber 341 rear the developer carrier 342, paired developer stirring and conveying members 343 and 344 are arranged capable of stirring and conveying developer in a circulating manner. Between the developer carrier 342 and the developer stirring and conveying member 343 disposed close to the developer carrier 342, a developer supply member 345 is provided capable of supplying the stirred and conveyed developer toward the developer carrier 342. The developer supplied to the developer carrier 342 is supplied to the developing zone with the layer thickness being regulated by a layer-thickness regulating member 346.

<Developer Replenishing System>

Figure 5:
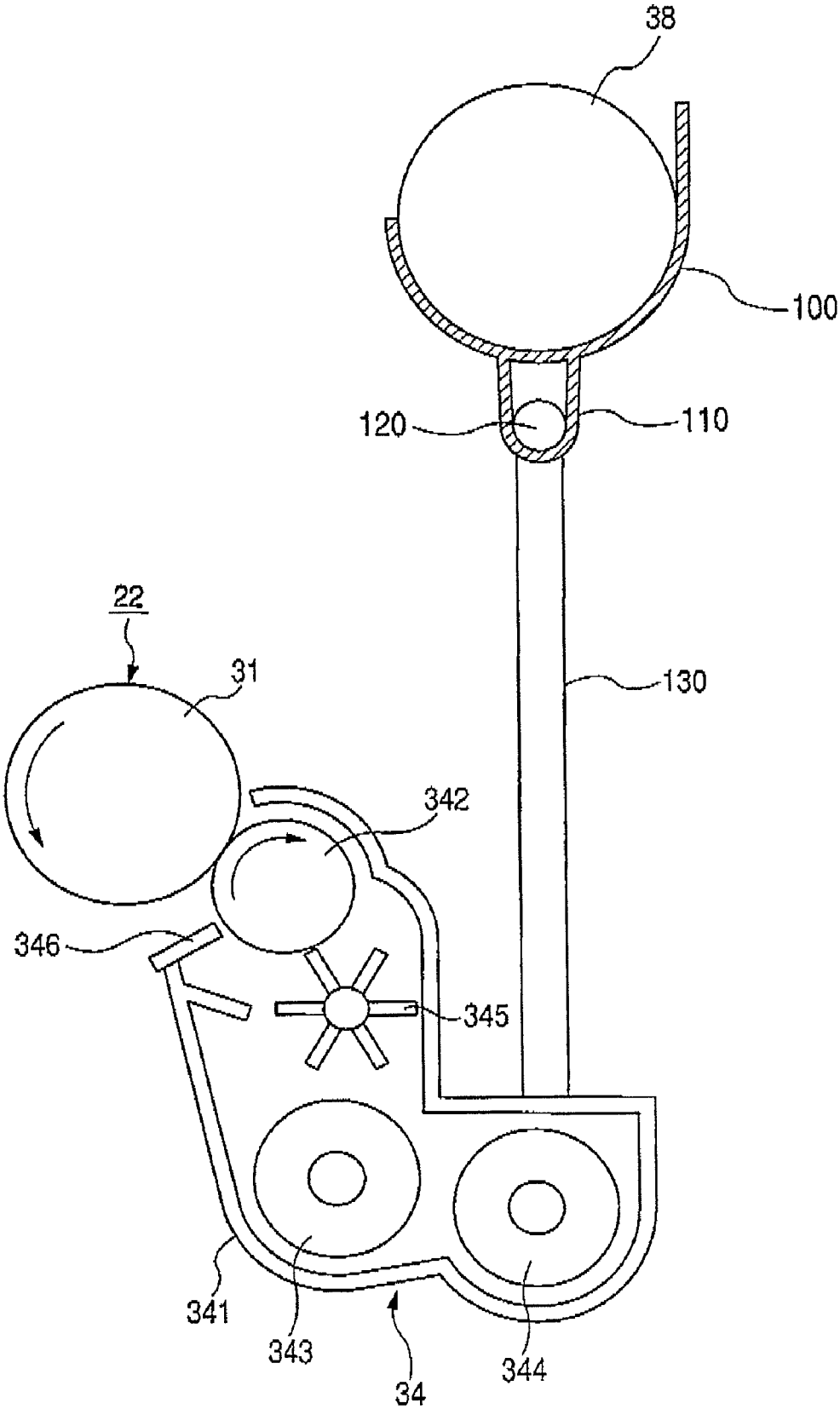
FIG. 5 is an explanatory diagram showing an example of a container receiving portion for the developer storage container used in the image forming apparatus shown in FIG. 3.

FIG. 5 shows an example of a developer replenishing system used in this exemplary embodiment.

In the drawing, the developer replenishing system includes a container receiving portion 100 which is formed in a portion of the apparatus chassis 21 and to which the developer storage container 38 is removably attached. In the lower portion of the container receiving portion 100, a reserve tank 110 is provided in which replenishing developer is temporarily stored. In the container receiving portion 100, discharge ports (not shown) are formed so that developer stored in the developer storage container 38 can be discharged when the developer storage container is attached thereto. In the reserve tank 110, a constant-amount supplying member 120 is provided so that a constant amount of developer stored in the tank can be supplied. Based on concentration information such as low developer concentration, the developing chamber 341 of the developing unit 34 is replenished with a predetermined amount of developer via a duct 130 connected to a portion of the reserve tank 110.

<Developer Storage Container>

Figure 6:
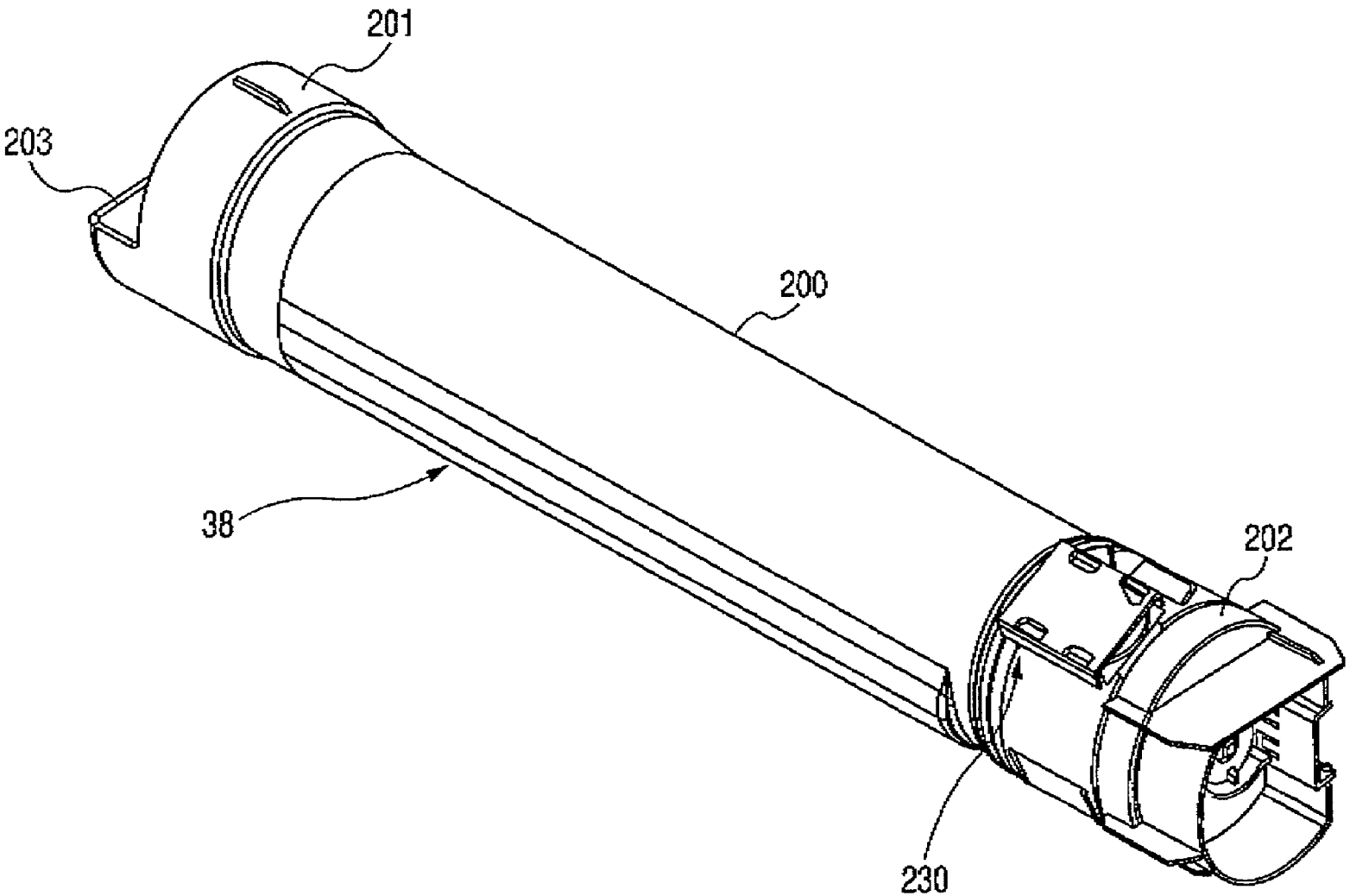
FIG. 6 is a perspective diagram showing an overall configuration of the developer storage container used in the first exemplary embodiment.
Figure 7:
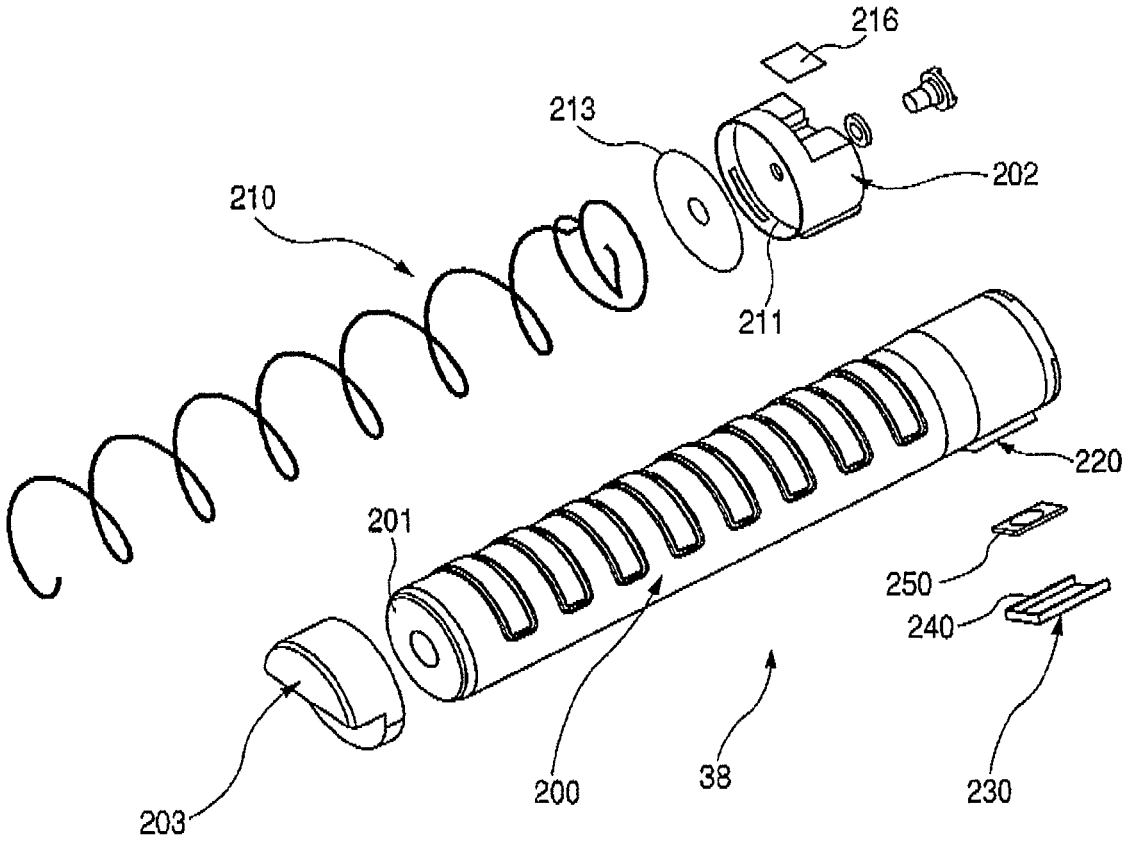
FIG. 7 is an exploded perspective view of the developer storage container shown in FIG. 6.

In this exemplary embodiment, as shown in FIGS. 6 and 7, the developer storage container 38 includes an elongated cylindrical container body 200 having open ends, made of synthetic resin such as ABS or PET, and formed by a stretch blow molding process. Within the container body 200, an agitator 210 as a stirring member capable of stirring stored developer is provided. At both ends of the cylindrical container body 200, end flanges 201 and 202 are attached.

Figure 8A:
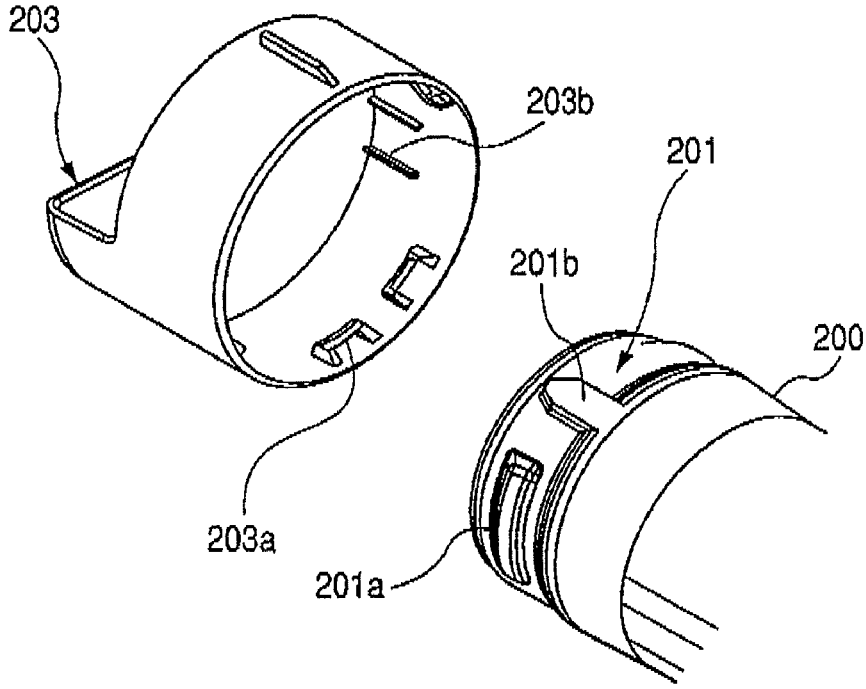
FIGS. 8A and 8B are explanatory diagrams showing details of the developer storage container in the vicinity of both ends thereof.

Here, a grasping handle 203 is provided at one end flange 201. As shown in FIG. 8A, the handle 203 is fitted to the one end flange 201. Further, drop-out preventing, elastic holding parts 203*a* are hooked on a step portion 201*a* of the end flange 201. A positioning end portion 201*b* of the end flange 201 is inserted into a rotation preventing concave portion 203*b*.

Figure 9A:
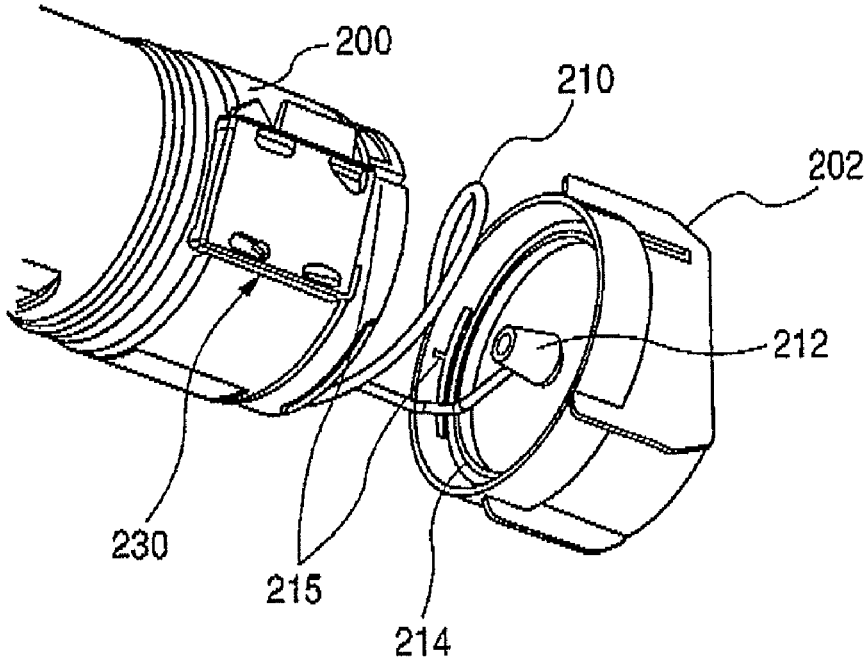
FIG. 9A is an explanatory diagram showing a state where one end flange of the developer storage container is detached.
Figure 9B:
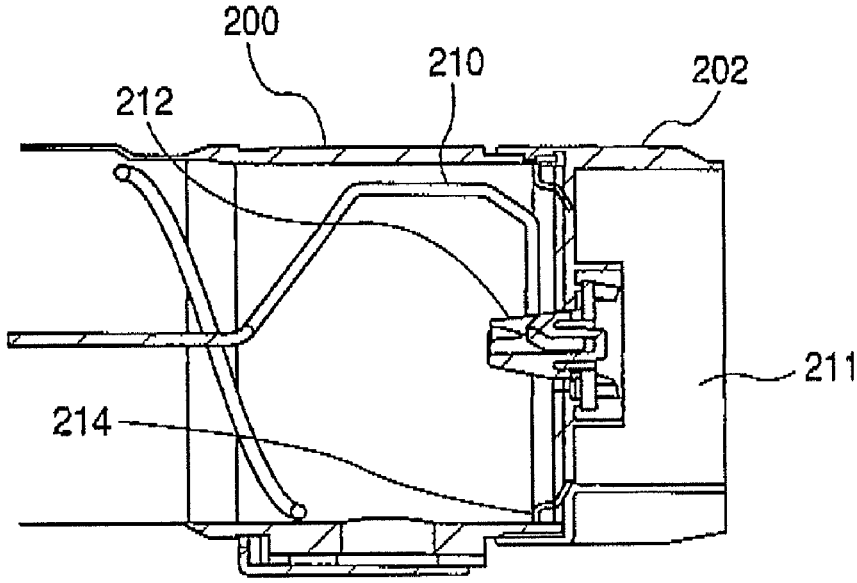
FIG. 9B is an explanatory diagram showing an example of an attachment structure for attaching an agitator to an end flange.

In the other end flange 202, as shown in FIG. 7 and FIGS. 9A and 9B, a rotor 211 is provided which is connected to a driving shaft from an external driving source (not shown). At the center of the inner surface of the rotor 211, a hook portion 212 is provided on which a shaft portion of the agitator 210 is hooked and supported. A sealing member 213 is provided between the end flange 202 and the container body 200. A ring-shaped sealing member 214 is provided between the rotor 211 and the end flange 202, thereby sealing a space therebetween. In addition, reference numeral 215 denotes rotation stoppers formed as a protrusion and a groove, provided, respectively, in the other end flange 202 and the container body 200 in a fitting manner.

Figure 8B:
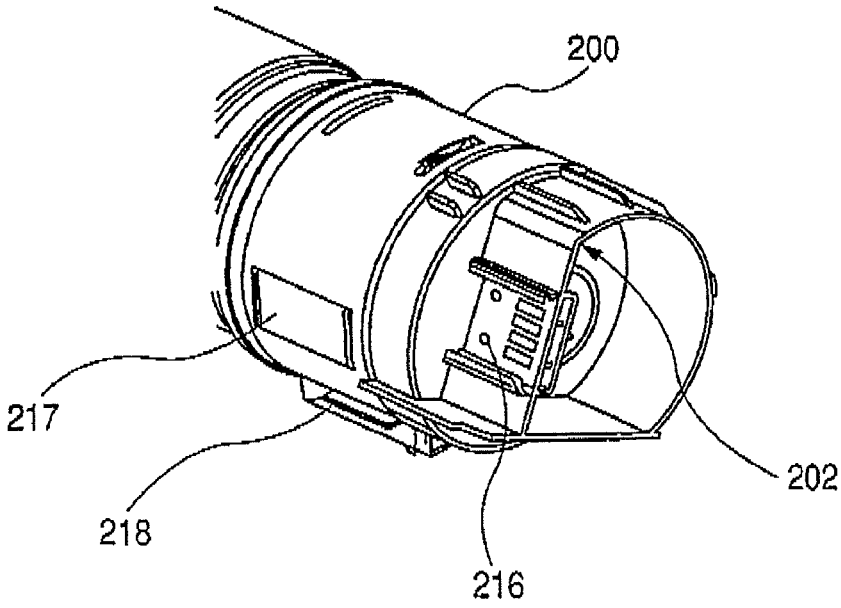

In this exemplary embodiment, as shown in FIG. 8B, a CRUM (Customer Replaceable Unit Memory) 216 as a usage management memory is attached to the other end flange 202. When the developer storage container 38 is attached to the container receiving portion 100, the CRUM 216 is connected so as to be able to communicate with a control unit (not shown) and usage history of the developer storage container 38 is recorded on the CRUM 216. Further, reference numeral 217 denotes a holding surface of the container body 200 during assembly or during developer filling operations, and reference numeral 218 denotes a rotation stopper when attaching the end flange 202.

<Shutter>

In this exemplary embodiment, a discharge opening 220 is formed in the vicinity of one end, in the longitudinal direction, of the peripheral wall of the cylindrical container body 200. A shutter 230, serving as an opening-and-closing mechanism, for opening/closing the opening 220 is provided for the discharge opening 220.

Figure 10:
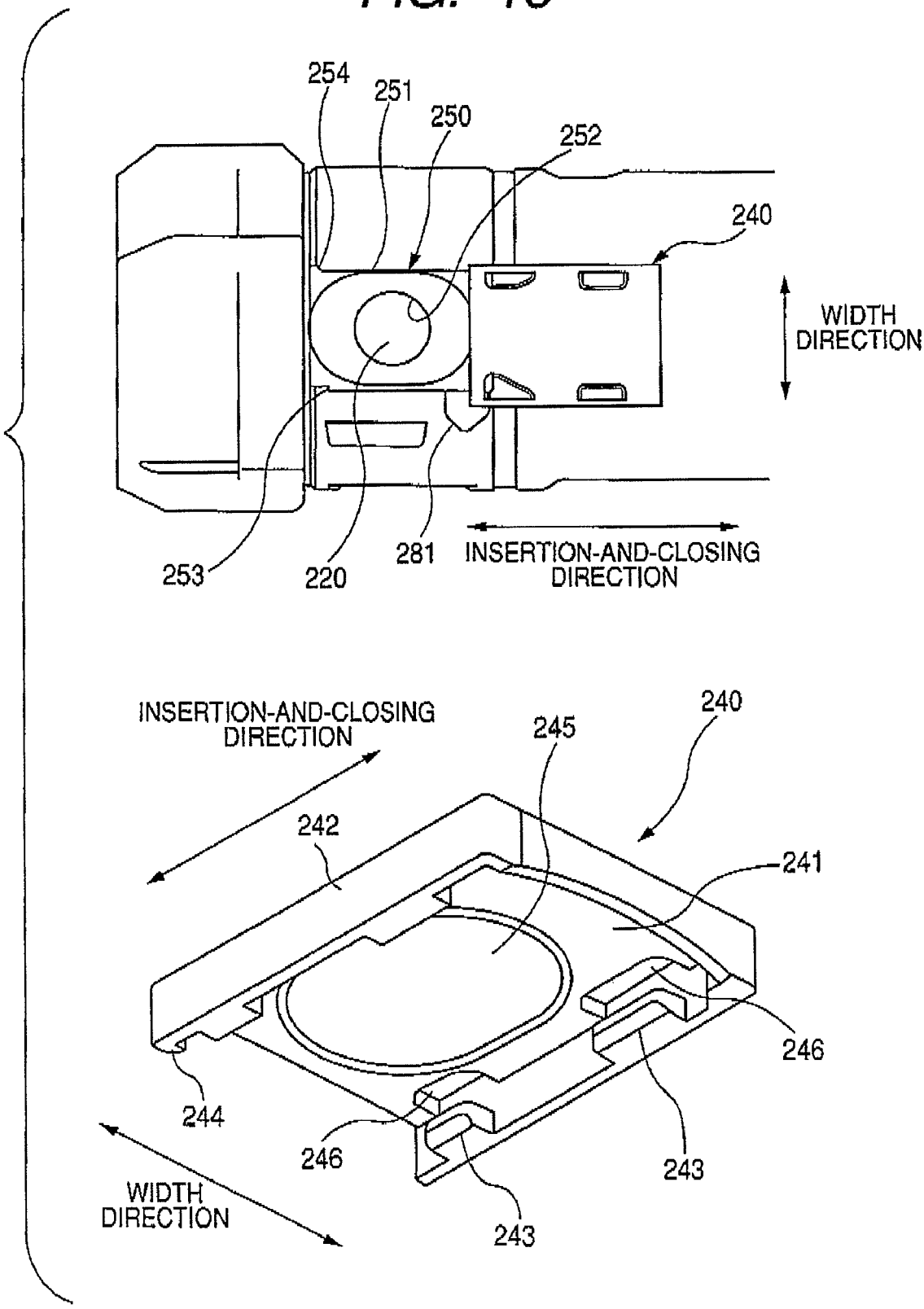
FIG. 10 is an explanatory diagram showing details of a shutter used in the first exemplary embodiment.

In this exemplary embodiment, as shown in FIG. 10, the shutter 230 includes an opening-and-closing cover 240 configured to block the discharge opening 220, and a cover holding frame 250 that holds the opening-and-closing cover 240 so that the opening-and-closing cover 240 is movable in an opening-and-closing direction.

<Opening-and-Closing Cover>

Here, the opening-and-closing cover 240 includes a cover body 241 having a substantially rectangular flat board shape and having a size at least larger than that of the discharge opening 220. Side walls 242 are formed to correspond to three sides of the cover body 241 other than one side corresponding to one direction of the opening-and-closing direction. The appropriate number of holding arms 243 are formed in the two side walls 242 on the both sides in a width direction perpendicular to the opening-and-closing direction. The holding arms 243 protrude inward from the side walls 242 to hold the cover holding frame 250 in an embracing manner (in this example, the two holding arms are provided for each side wall and are separate in the opening-and-closing direction). Furthermore, a hook claw 244 serving as a stopper portion is formed in an open end of the side wall 242 being located on one side, in the width direction, of the cover body 241. In addition, an elastic sealing member 245 is provided, for example, by adhesive bonding, on a surface of the cover body 241, which faces the cover holding frame 250. The elastic sealing member 245 is configured to be in elastic contact with the surface of the cover holding frame 250.

In this example, holes 246 are formed in portions of the cover body 241, which correspond to the holding arms 243. The opening-and-closing cover 240 is configured to be stably movable along the both side edges of the cover holding frame 250 in a state in which the both ends of the cover holding frame 250 are held at three points by the two holding arms 243 and the cover body 241, which is disposed between these holding arm 243.

<Cover Holding Frame>

In this exemplary embodiment, the cover holding frame 250 includes a frame body 251 having a substantially rectangular flat board shape. A through hole 252 is formed in a portion of the frame body 251, which corresponds to the discharge opening 220. A notch-shaped blocking portion 253 is formed in one corner portion of an edge of the frame body 251 in the closing direction of the opening-and-closing cover 240. A position regulating protrusion 254 is formed in the other corner portion of the edge of the frame body 251 so as to protrude in the width direction perpendicular to the opening-and-closing direction.

In particular, in this exemplary embodiment, a dimension between the both edges, in the width direction, of the cover holding frame 250 is set so as to be slightly smaller than that between the side walls 242 on the both sides of the opening-and-closing cover 240 in the width direction.

Figure 11:
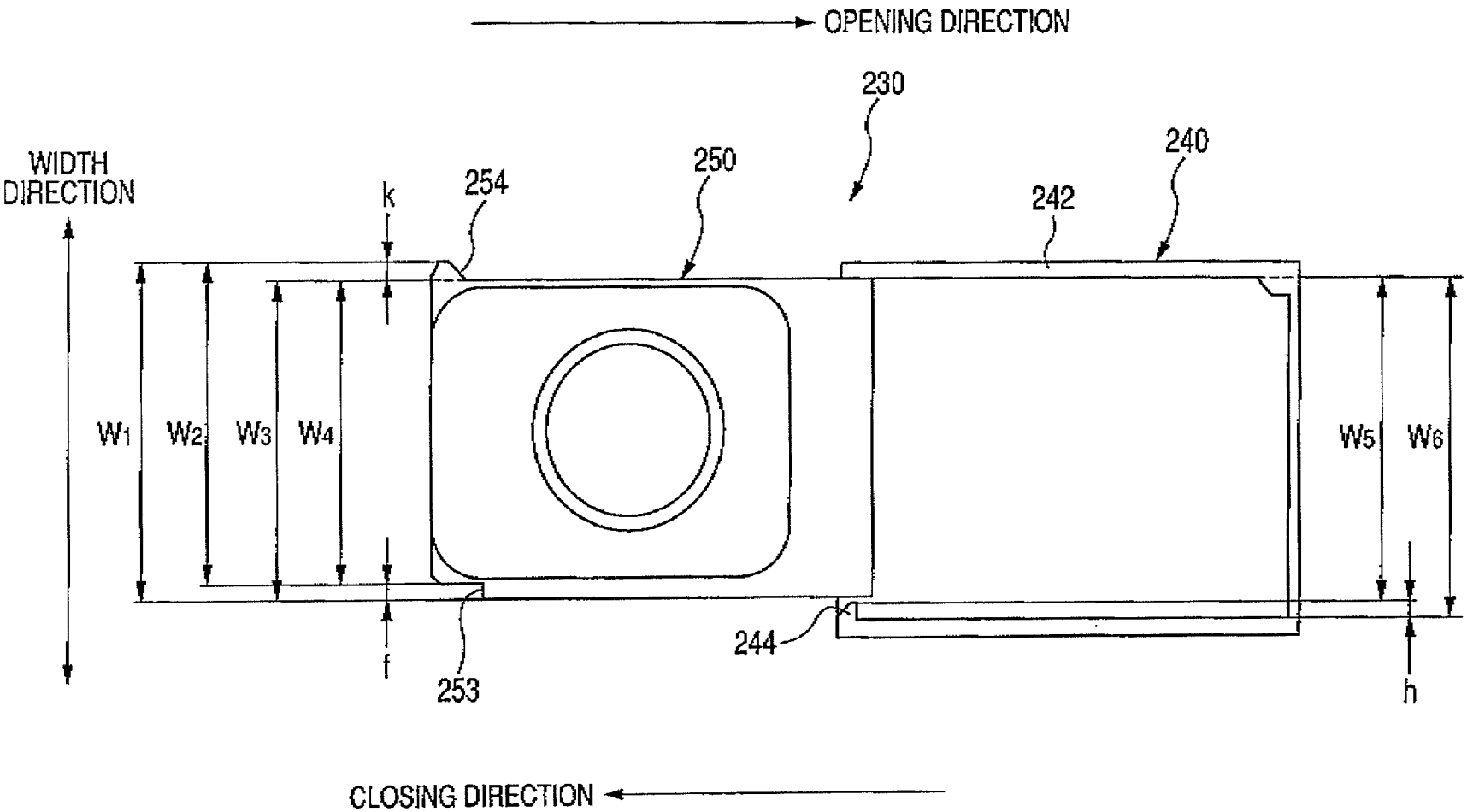
FIG. 11 is an explanatory diagram showing details of a dimension relation for the shutter (an opening-and-closing cover and a cover holding frame) used in the first exemplary embodiment to perform an opening/closing operation.

Furthermore, in this exemplary embodiment, as shown in FIGS. 10 and 11, a dimension k of a protrusion of the position regulating protrusion 254 from a reference position of the both edges, in the width direction, of the cover holding frame 250 is larger than that, in the width direction, of the blocking portion 253. When the side wall 242, in the width direction, of the opening-and-closing cover 240 abuts against the reference position of the side edge, in the width direction, of the cover holding frame 250, the opening-and-closing cover 240 has moved in the width direction by an amount corresponding to the dimension k of the protrusion of the position regulating protrusion 254. As a result, the hook claw 244 of the opening-and-closing cover 240 is not in contact with the blocking portion 253 and they are maintained in a positional relation that the restriction state is released.

FIG. 11 shows the dimension relation in order for the shutter 230 (the opening-and-closing cover 240 and the cover holding frame 250) to perform the opening/closing operation.

In this figure, w1 to w6, f, h, and k are defined as follows:

w1 denotes the maximum width of the cover holding frame 250 up to a distal end of the position regulating protrusion 254.

w2 denotes a width of the cover holding frame 250 from the distal end of the position regulating protrusion 254 to the blocking portion 253.

w3 denotes a width of the cover holding frame 250 between the both sides excluding the position regulating protrusion 254.

w4 denotes a width of the cover holding frame 250 from one side thereof to the blocking portion 253 excluding the position regulating protrusion 254.

w5 denotes a width of the opening-and-closing cover 240 from an inner surface of one side wall thereof in the width direction to the stopper portion 244.

w6 denotes the maximum width of the opening-and-closing cover 240 between the both side walls 242 in the width direction excluding the stopper portion 244.

f denotes a blocking length of the blocking portion 253.

h denotes a hooking length of the stopper portion 244 (hook claw).

k denotes a protrusion dimension of the position regulating protrusion 254.

With reference to this figure, conditions required for the case where the opening-and-closing cover 240 is fitted to the cover holding frame 250 will be considered. If w2>w5 and w3>w5, the opening-and-closing cover 240 cannot be fitted to the cover holding frame 250. Therefore, it is necessary to satisfy the relationships of w5−w2>0 and w5−w3>0.

Next, if w1<w5, even when the opening-and-closing cover 240 is moved along the distal end position of the position regulating protrusion 254, the hook claw 244 serving as the stopper portion does not overlap the blocking portion 253 in the opening-and-closing direction. Therefore, there is a concern that the blocking portion 253 does not function as the movement restricting unit. Accordingly, it is necessary to satisfy the relationship of w1−w5>0.

Then, the blocking length f (=w1−w2) of the blocking portion 253 will be considered. It is necessary that f is larger than the gap of w5−w2; that is, it is necessary to satisfy the relationship of f−(w5−w2)>0, that is, f>w5−w2.

Similarly, considering the protrusion dimension k (=w1−w3) of the position regulating protrusion 254, it is necessary that k is larger than the gap of w5−w3, that is, it is necessary to satisfy the relationship of k−(w5−w3)>0, that is, k>w5−w3.

Furthermore, if the hooking length h (=w6−w5) of the hook claw 244 serving as the stopper portion is small, w1>w6 may be true and it becomes unable to perform fitting. Therefore, in order to enable the fitting, it is necessary to satisfy the relationship of w6−w1>0.

In this case, it is necessary that h is larger than w6−w1, that is, it is necessary to satisfy the relationship of h−(w6−w1)>0, that is, h>w6−w1.

<Shutter Operation Flow>

In this exemplary embodiment, the shutter 230 is operated in accordance with an operation flow as shown in FIGS. 12 to 15.

Figure 12A:
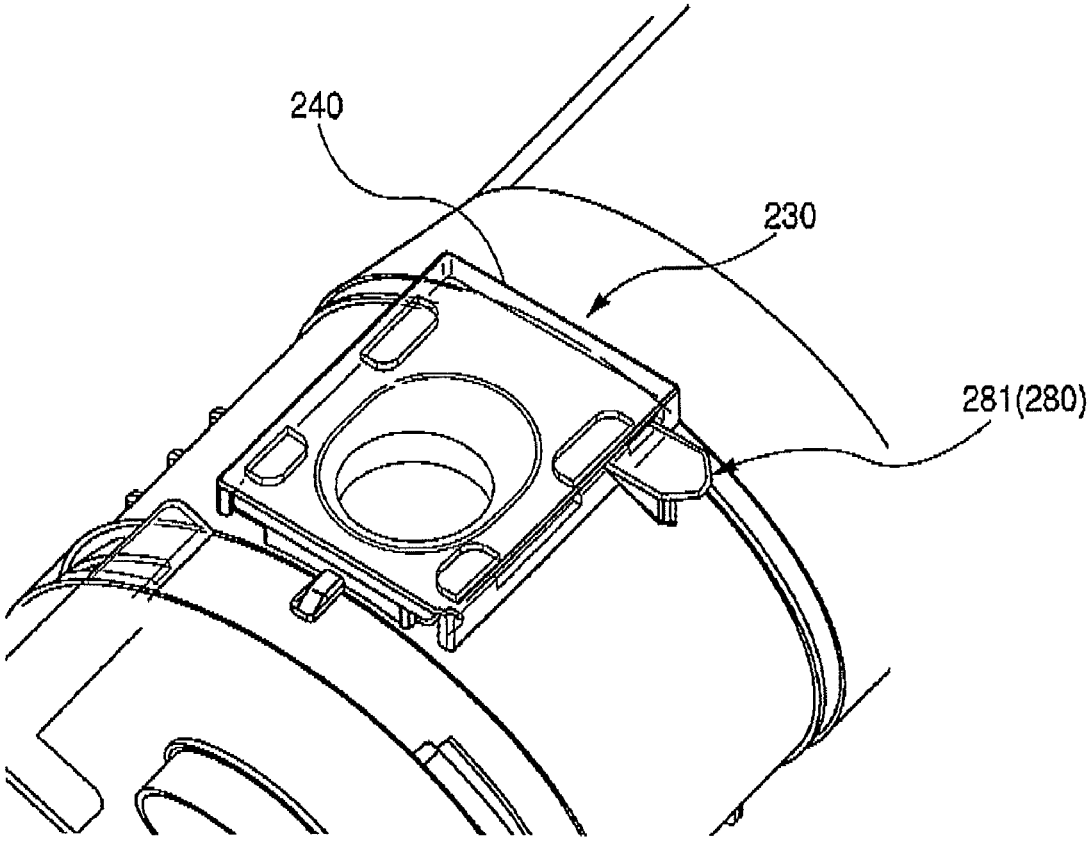
FIG. 12A is a perspective diagram showing a state where the shutter is located in a closing position.
Figure 12B:
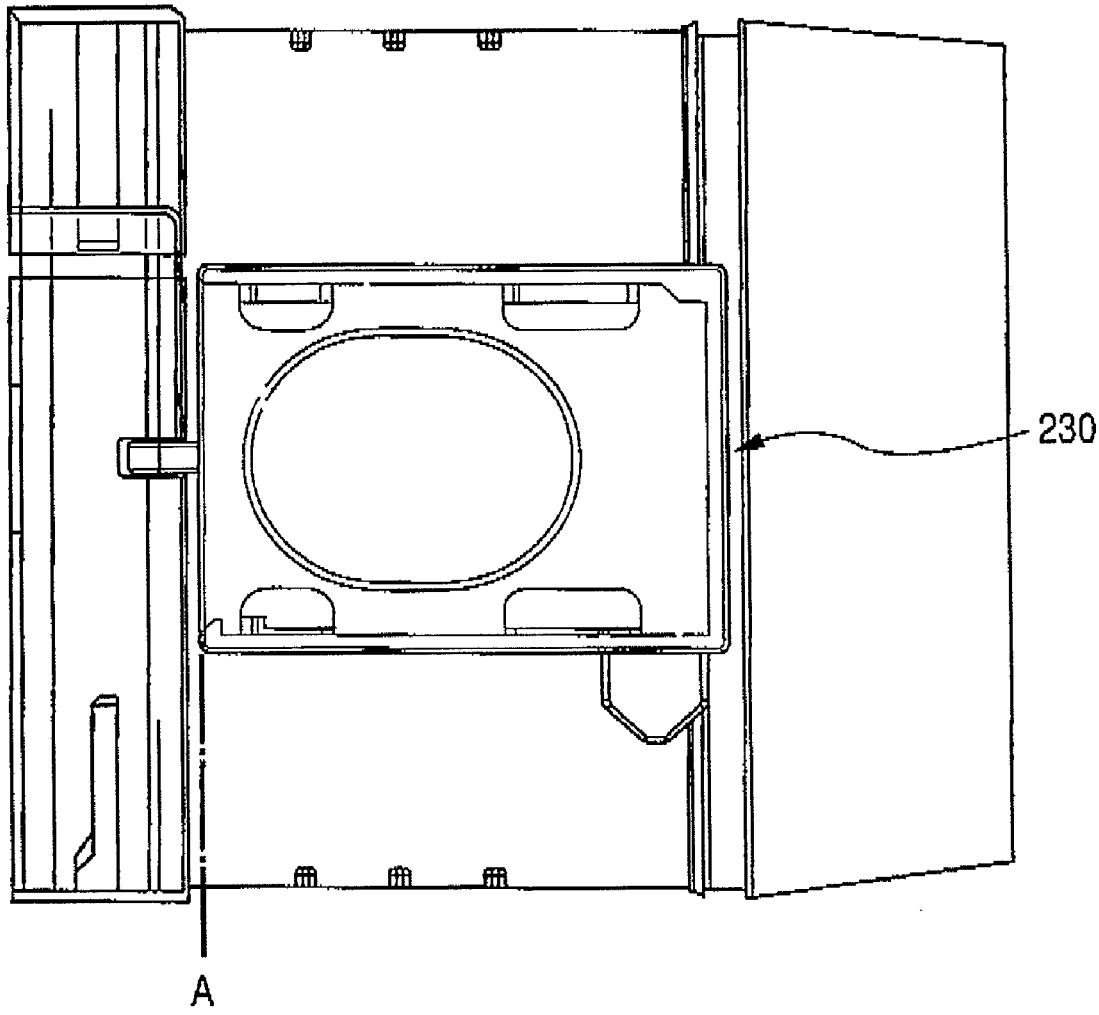
FIG. 12B is an explanatory top view of FIG. 12A.

(1) Shutter Close (FIGS. 12A and 12B)

FIGS. 12A and 12B show the state in which the opening-and-closing cover 240 is located in the closing position A where the discharge opening 220 is completely closed.

Figure 16A:
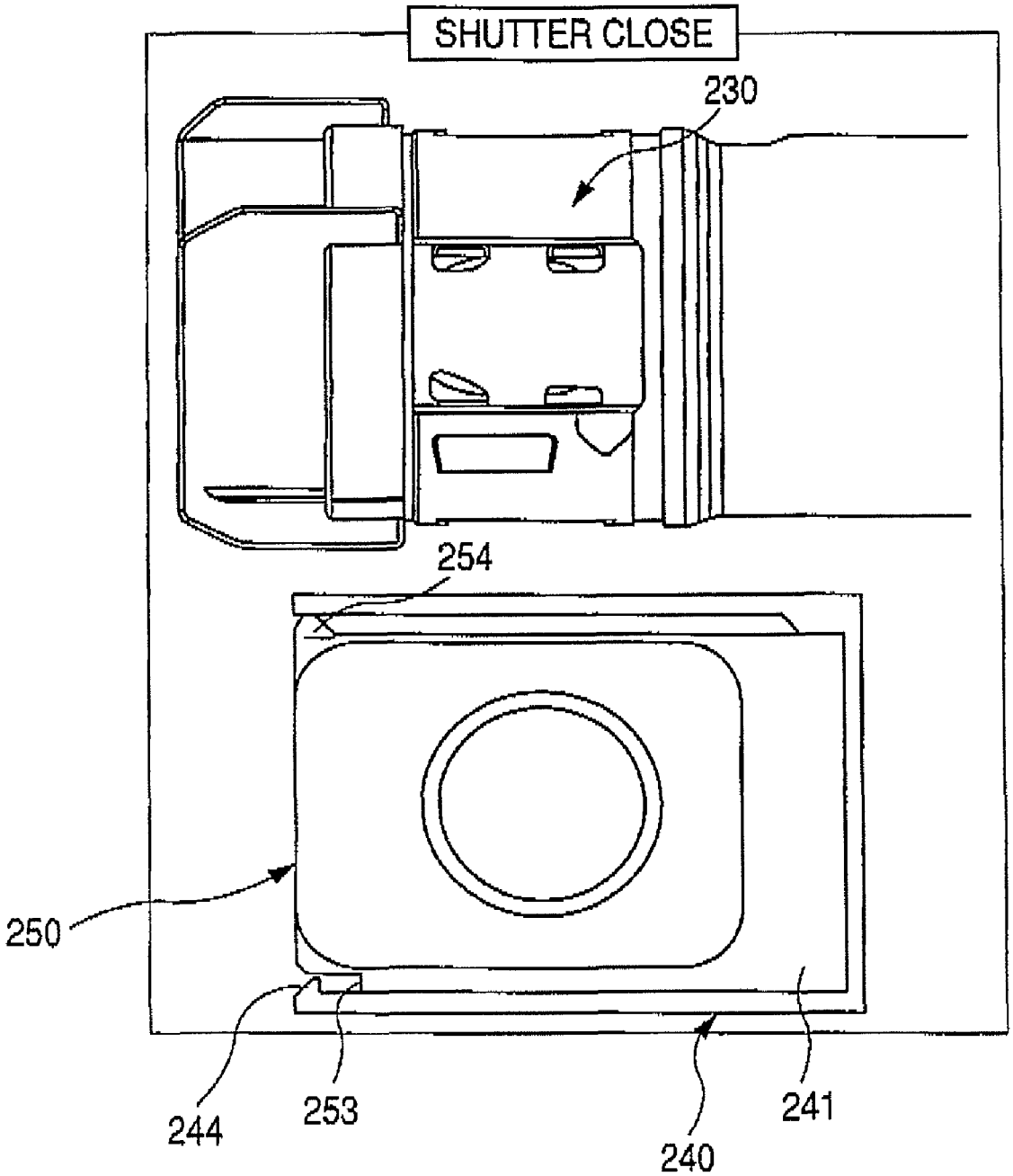
FIG. 16A is an explanatory diagram showing an operation flow of the shutter being located in the closing position.

At that moment, as shown in FIG. 16A, the side wall 242, in the opening-and-closing direction, of the opening-and-closing cover 240 abuts against one end of the cover holding frame 250 in the opening-and-closing direction. The side wall 242, in the width direction, of the opening-and-closing cover 240 is located in a position where the side wall 242 abuts against the distal end of the position regulating protrusion 254 of the cover holding frame 250.

Figure 13A:
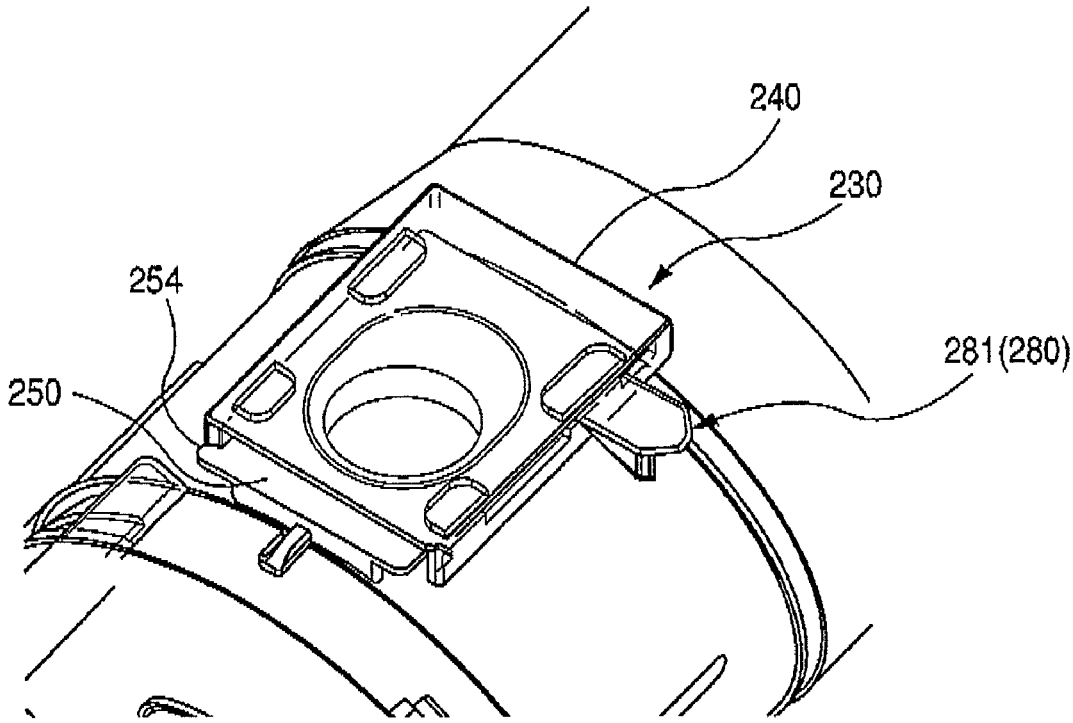
FIG. 13A is a perspective diagram showing a lock state when the shutter is located in an intermediate position.
Figure 13B:
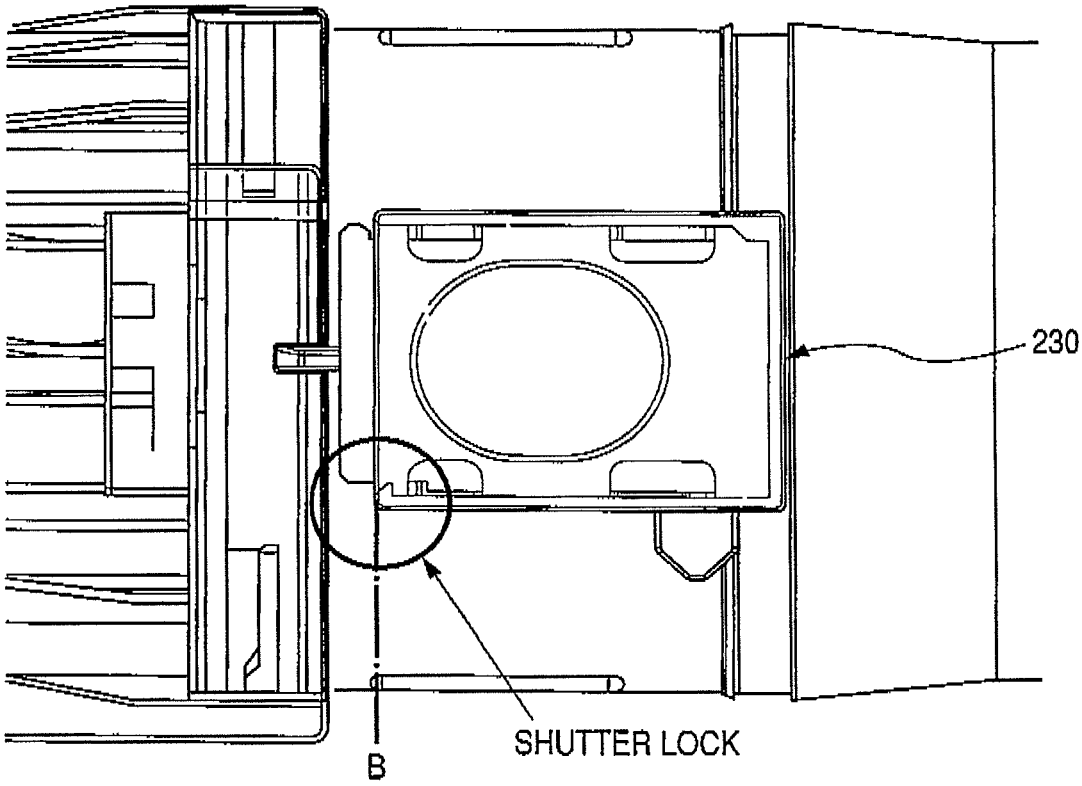
FIG. 13B is an explanatory top view of FIG. 13A.

(2) Shutter Lock (FIGS. 13A and 13B)

Figure 16B:
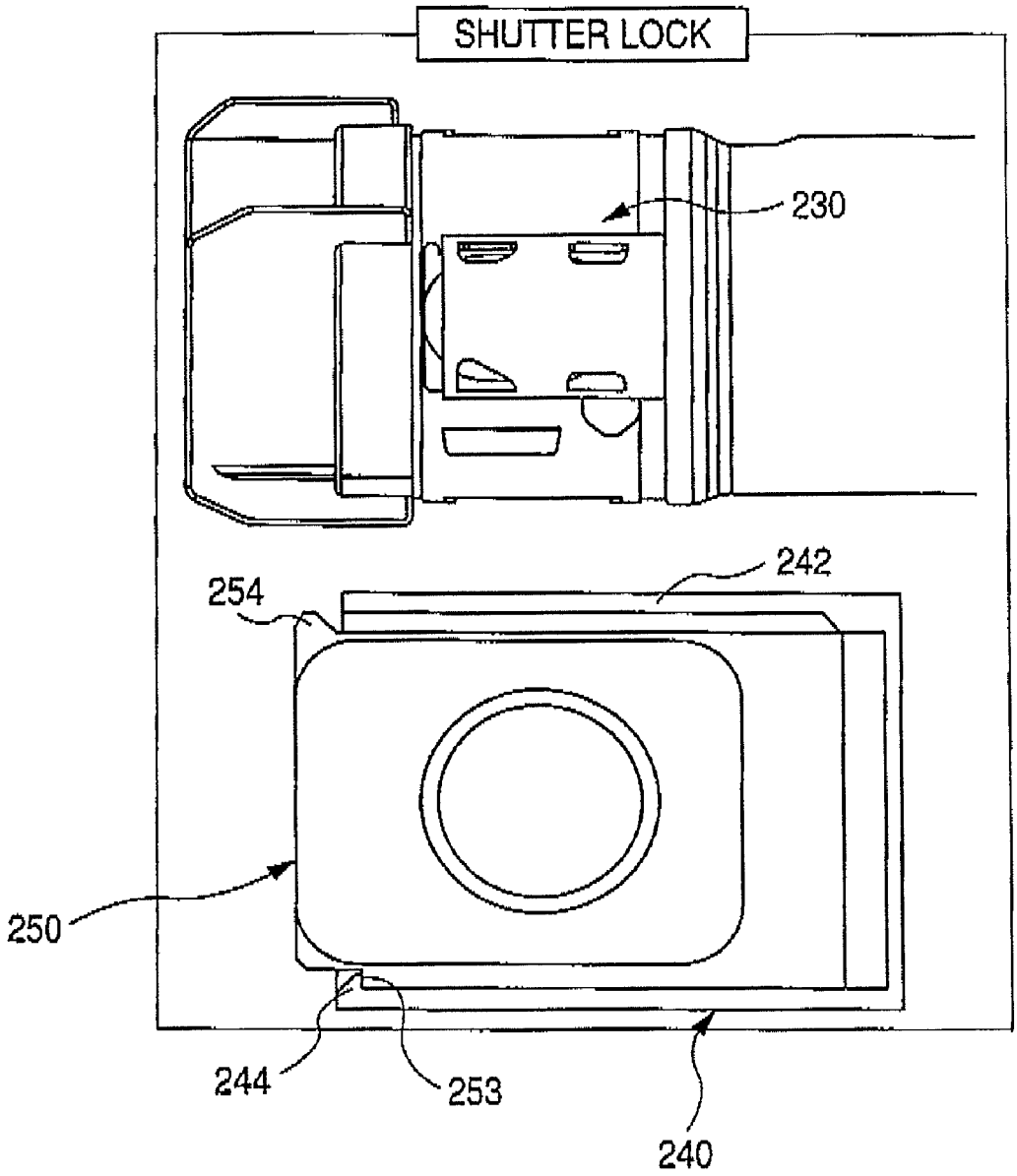
FIG. 16B is an explanatory diagram showing an operation flow of the shutter being in the lock state.

When the opening-and-closing cover 240 moves in the opening direction from the state of FIGS. 12A and 12B, as shown in FIGS. 13A and 13B, the opening-and-closing cover 240 moves while maintaining the state that the position of the opening-and-closing cover 240 is regulated by the position regulating protrusion 254. Then, the hook claw 244 of the opening-and-closing cover 240 abuts against the blocking portion 253 (see FIG. 16B).

At that moment, since the movement of the opening-and-closing cover 240 is restricted in the intermediate position B, the shutter 230 is locked with respect to the opening-and-closing direction.

For this reason, if the developer storage container 38 is erroneously dropped during an attachment operation of the developer storage container 38 or even if shock absorbing materials such as foamed polystyrene are not filled on both sides of a box-shaped corrugated board during transport, there is little fear of erroneous opening of the shutter 230.

Figure 14A:
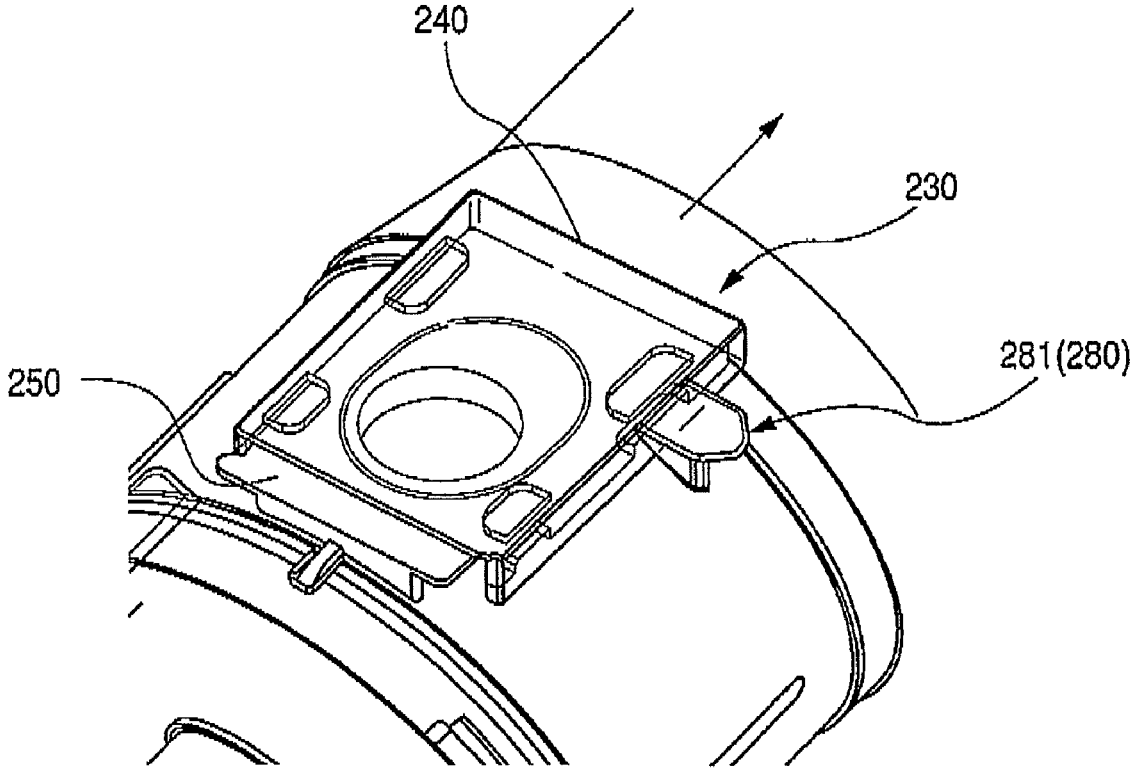
FIG. 14A is a perspective diagram showing an unlock state of the shutter.
Figure 14B:
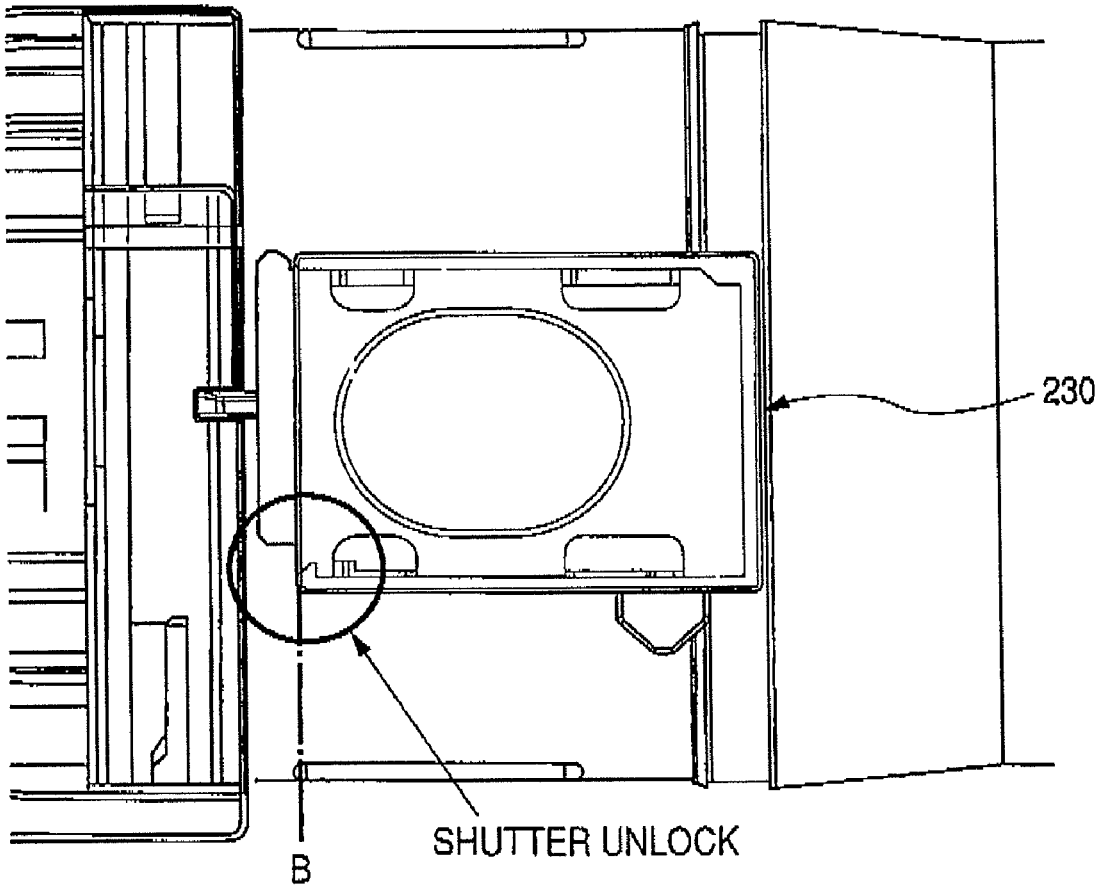
FIG. 14B is an explanatory top view of FIG. 14A.

(3) Shutter Unlock (FIGS. 14A and 14B)

As discussed in Section (2), in the shutter lock state, the side walls 242, in the width direction, of the opening-and-closing cover 240 are moved to a position beyond the position regulating protrusion 254 of the cover holding frame 250. Therefore, the opening-and-closing cover 240 is allowed to move in the width direction (intersecting direction) intersecting the opening-and-closing direction toward both one edge, in the width direction, of the cover holding frame 250.

Here, the opening-and-closing cover 240 continues moving in the width direction until one side wall 242 in the width direction abuts against the reference position of the edge, in the width direction, of the cover holding frame 250.

Figure 17A:
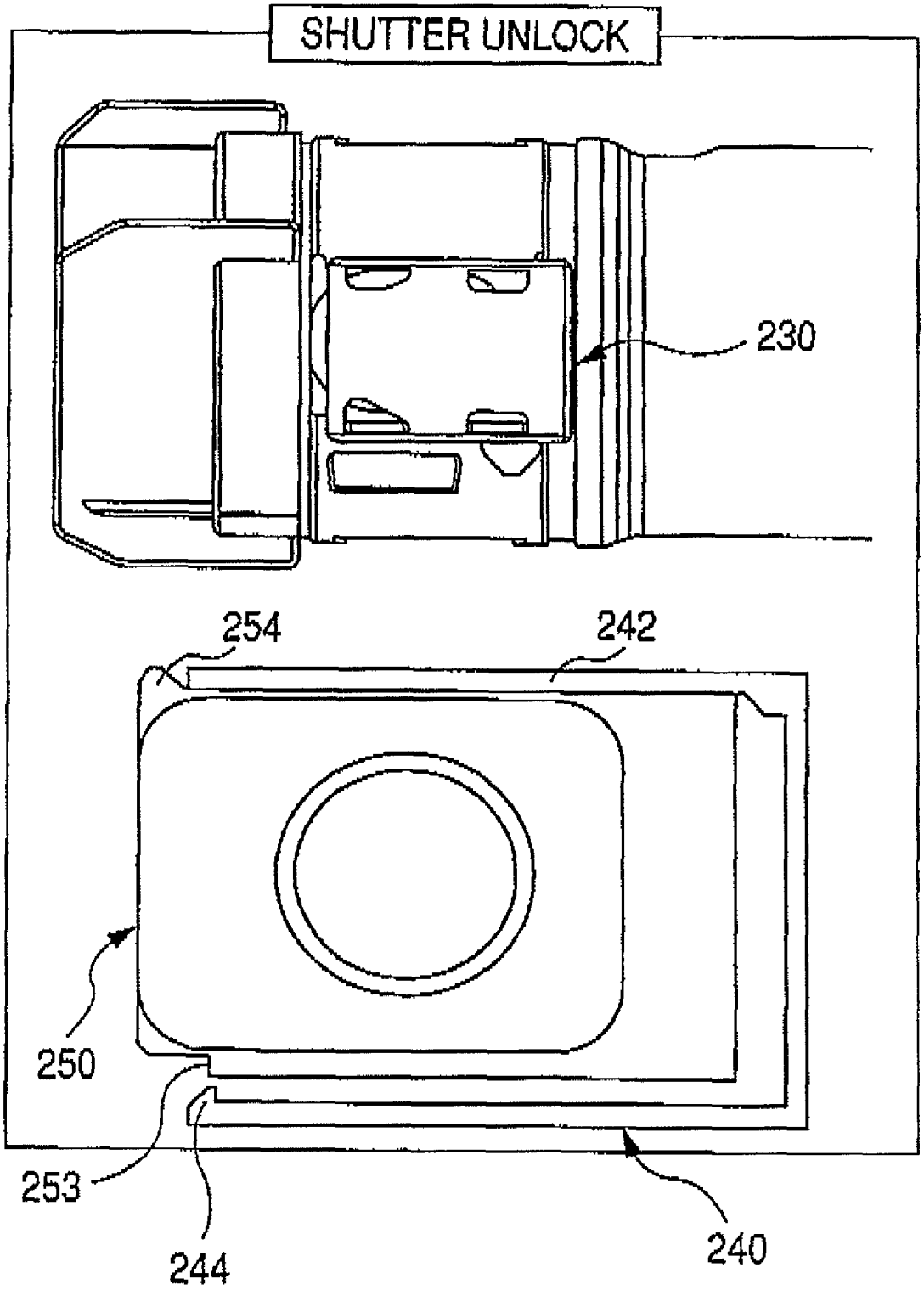
FIG. 17A is an explanatory diagram showing an operation flow of the shutter being in the unlock state.

At that moment, as shown in FIG. 17A, since the hook claw 244 of the opening-and-closing cover 240 moves to a position in which it is not in contact with the blocking portion 253 of the cover holding frame 250, the hook claw 244 is brought in a state where it is movable in the opening-and-closing direction of the opening-and-closing cover 240. As a result, the restriction state where the opening-and-closing cover 240 is restricted by the blocking portion 253 and the hook claw 244 is released. That is, the lock state of the shutter 230 with respect to the opening-and-closing direction is released, and the shutter 230 becomes movable in the opening-and-closing direction.

Figure 15A:
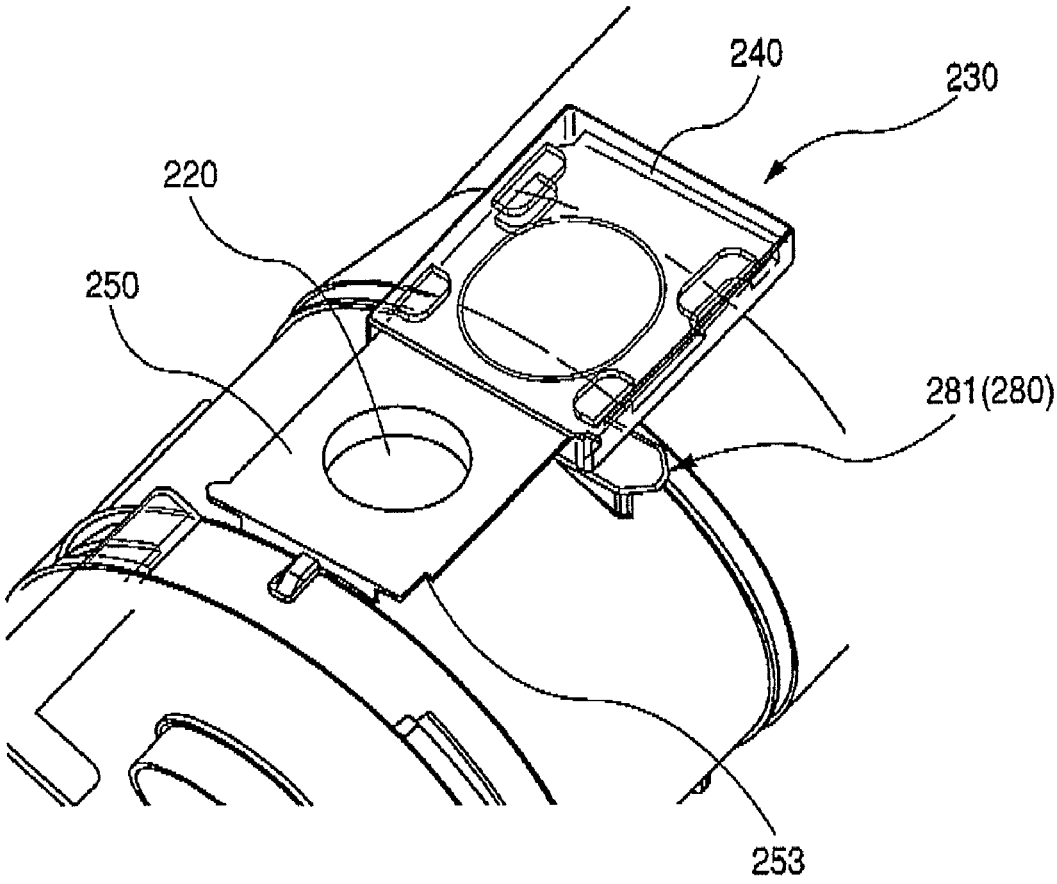
FIG. 15A is a perspective diagram showing a state where the shutter is located in an opening position.
Figure 15B:
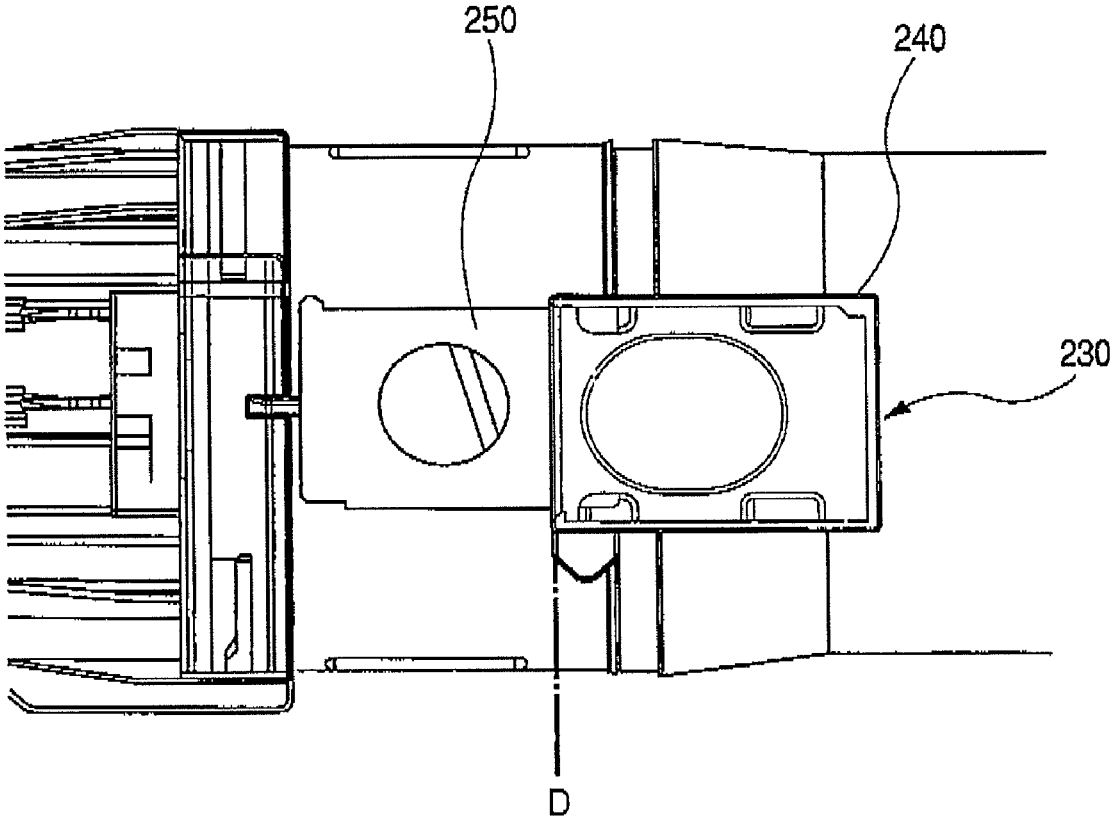
FIG. 15B is an explanatory top view of FIG. 15A.

(4) Shutter Open (FIGS. 15A and 15B)

As discussed in Section (3), when the shutter 230 is unlocked, the cover 240 is allowed to move in the opening-and-closing direction. Therefore, as shown in FIGS. 15A and 15B, the opening-and-closing cover 240 moves to the opening position D. Thereby, the discharge opening 220 is completely open.

Figure 17B:
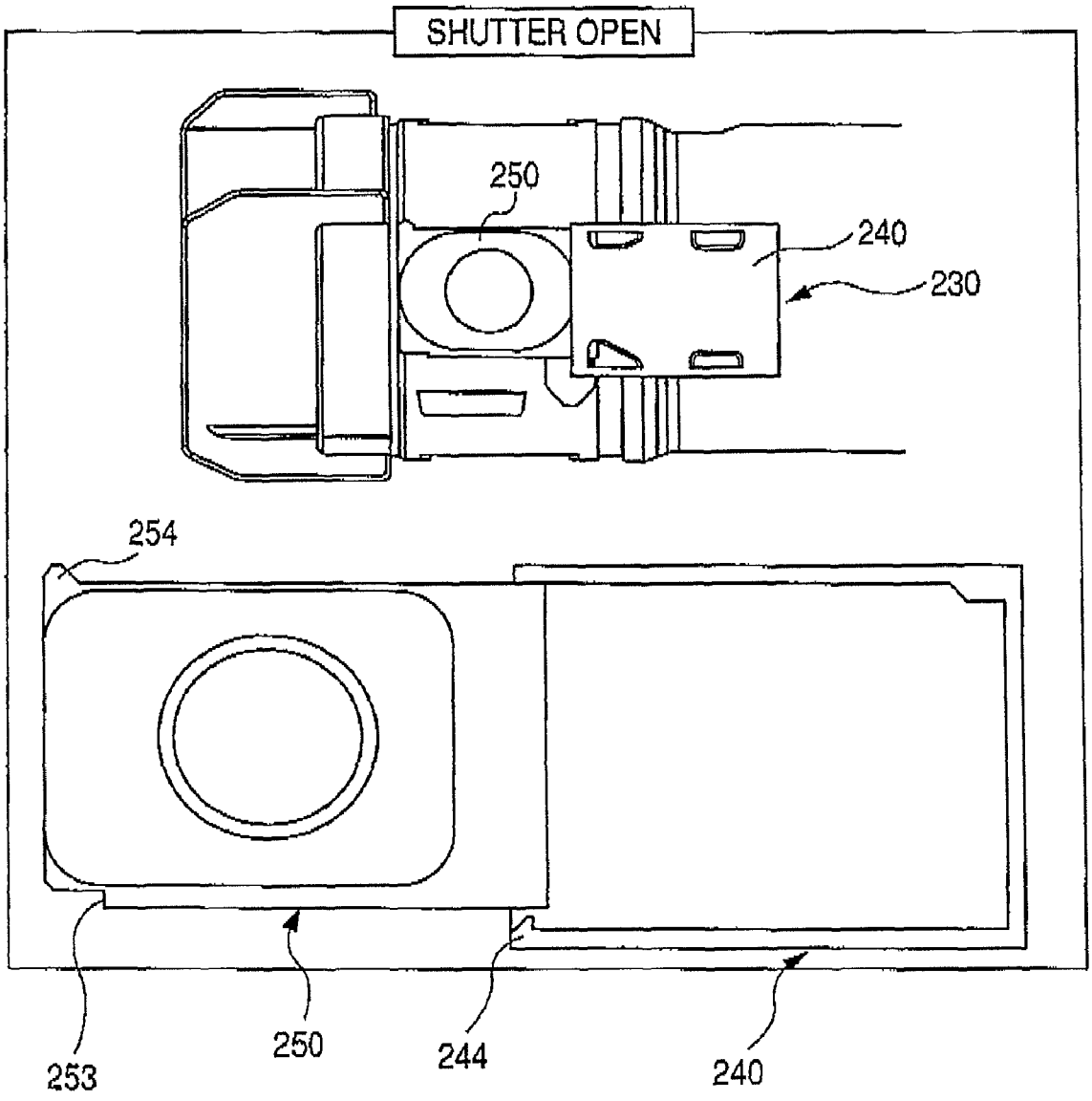
FIG. 17B is an explanatory diagram showing an operation flow of the shutter being located in the opening position.

At that moment, as shown in FIG. 17B, since the hook claw 244 of the opening-and-closing cover 240 moves along the edge, in the width direction, of the cover holding frame 250 in a non-contact manner, it does not interfere with the opening operation of the opening-and-closing cover 240. Thus, the opening-and-closing cover 240 moves to an end position (opening position D).

In such a state, in this exemplary embodiment, since there is no biasing force by spring or the like acting between the opening-and-closing cover 240 and the cover holding frame 250, a user can move the opening-and-closing cover 240 without being required to apply a strong force in the opening-and-closing direction.

To the contrary, in a comparative example in which an opening-and-closing cover is elastically held with respect to a cover holding frame by a biasing force of a spring or the like, since a sliding resistance caused by the biasing force of the spring acts between the opening-and-closing cover and the cover holding frame, a non-negligible operation force is required to move the opening-and-closing cover in the opening-and-closing direction.

In another comparative example in which the movement restricting unit is not provided, in order to maintain good closing performance of the opening-and-closing mechanism against impact during an dropping accident or during transport, it is necessary to make the opening-and-closing cover difficult to move by using a thick elastic sealing member 245 so that the opening-and-closing cover won't move in the event of impact during the dropping accident. However, by doing this, it may require a strong operation force in the opening-and-closing direction, although it became able to endure strong impact during dropping accidents.

<Container Receiving Portion>

In this exemplary embodiment, the container receiving portion 100 includes functional portions that enable the opening/closing operation of the shutter 230 via the shutter lock state and the shutter unlock state as described above when the developer storage container 38 is inserted and removed.

Figure 18:
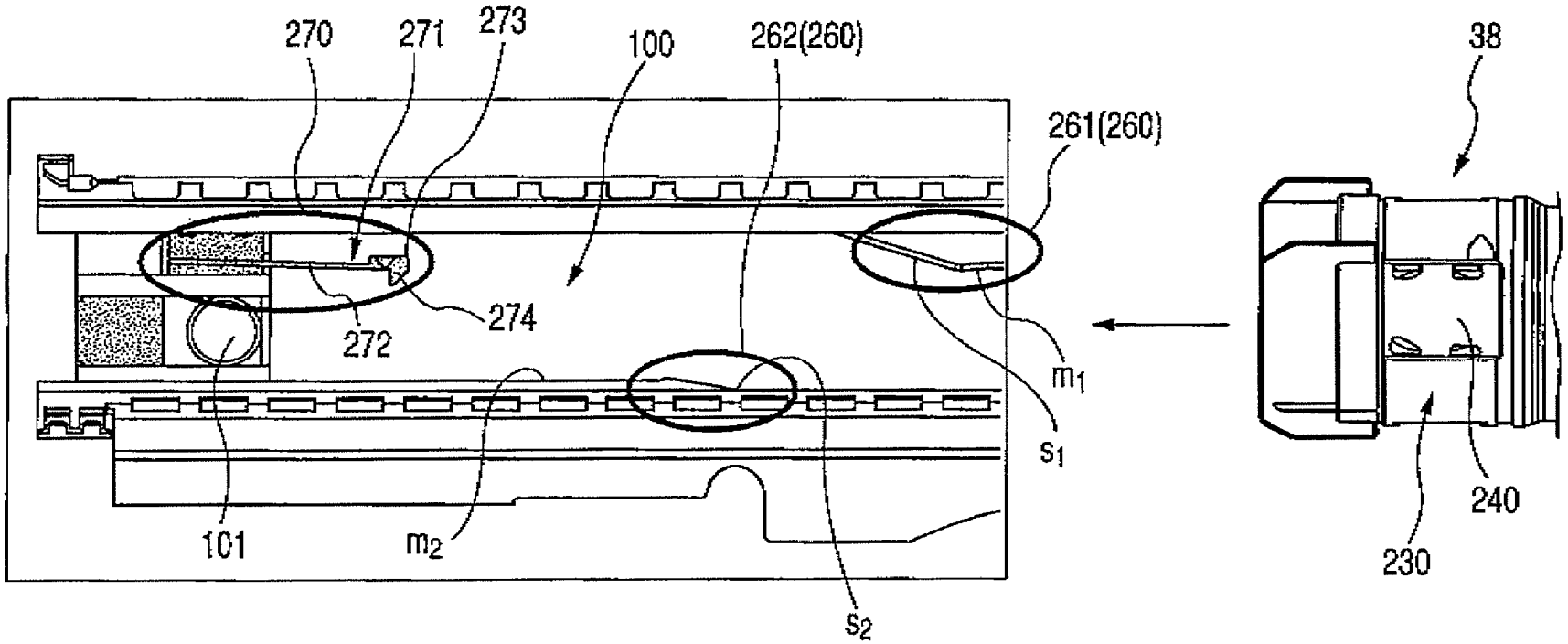
FIG. 18 is an explanatory diagram showing details of the container receiving portion used in the first exemplary embodiment.

In this exemplary embodiment, as shown in FIG. 18, the container receiving portion 100 includes a cover guide rail 260, a movable cover holding mechanism 270 and a cover holding releasing mechanism 280. The cover guide rail 260 guides a movement locus of the opening-and-closing cover 240 of the developer storage container 38. When insertion of the developer storage container 38 is being completed, the movable cover holding mechanism 270 abuts against the opening-and-closing cover 240 so as to move the opening-and-closing cover 240 toward the opening position D and then holds the opening-and-closing cover 240. When the developer storage container 38 is being removed, the movable cover holding mechanism 270 moves the opening-and-closing cover 240, which is located in the opening position D, toward the closing position A. When the developer storage container 38 is being removed, the cover holding releasing mechanism 280 (see FIG. 12) releases the holding state in which the opening-and-closing cover 240 is held by the movable cover holding mechanism 270 at a point of time at which the opening-and-closing cover 240 reaches the closing position A. In FIG. 18, reference numeral 101 designates a through hole connected to the reserve tank 110. FIG. 18 is a schematic view of the container receiving portion 100 and the developer storage container 38 when viewed from the through-hole 101 side.

<Cover Guide Rail>

The cover guide rail 260 has a first guide surface m1 that regulates a position of the side wall 242, in the width direction, of the opening-and-closing cover 240 when the shutter 230 is located in the closing position A in the container receiving portion 100. The cover guide rail 260 includes a first cover guide rail 261 and a second cover guide rail 262. The first cover guide rail 261 releases the regulation caused by the first guide surface m1 in the midway thereof. The second cover guide rail 262 is provided on the inner side than the first cover guide rail 261 and guides the shutter 230 to a second guide surface m2 in which the shutter 230 is moved from the lock position to the unlock position.

In particular, in this exemplary embodiment, the first cover guide rail 261 has an inclined guide surface S1 that extends outward from the end of the first guide surface m1. The second cover guide rail 262 is configured to guide the opening-and-closing cover 240 of the shutter 230 to the second guide surface m2 via an inclined guide surface S2 after the regulation caused by the first guide surface m1 is completely released.

<Movable Cover Holding Mechanism>

The movable cover holding mechanism 270 includes an elastic holding part 271 that is elastically deformable and extends in the opening-and-closing direction of the opening-and-closing cover 240. The elastic holding part 271 is obtained by integrally forming a hook-shaped holding protrusion 273 at a distal end of an elastically deformable plate member 272. Furthermore, at the distal end of the holding protrusion 273, an inclined guide portion 274 is provided which is elastically deformable outward when it abuts against the opening-and-closing cover 240. The elastic holding part 271 having such a configuration abuts against opening-and-closing cover 240 when the developer storage container 38 is being inserted, so as to move the opening-and-closing cover 240 to the opening position D. When the opening-and-closing cover 240 reaches the opening position D, the elastic holding part 271 is elastically deformed outward so as to be apart from the opening-and-closing cover 240, and thereafter the elastic holding part 271 holds the opening-and-closing cover 240 in the opening position D.

<Cover Holding Releasing Mechanism>

The cover holding releasing mechanism 280 (see FIG. 12) includes a holding releasing protruding part 281. When the opening-and-closing cover 240 reaches the closing position A, the holding releasing protruding part 281 (see FIG. 21) elastically deforms the elastic holding part 271 so that the elastic holding part 271 is apart from the opening-and-closing cover 240. The holding state in which the elastic holding part 271 holds the opening-and-closing cover 240 is released by the holding releasing protruding part 281.

In this exemplary embodiment, as shown in FIG. 10 and FIGS. 12 to 15, the holding releasing protruding part 281 is provided in the vicinity of the cover holding frame 250 of the shutter 230. When the developer storage container 38 is being removed from the container receiving portion 100, the holding releasing protrusion part 281 acts on the elastic holding part 271 of the movable cover holding mechanism 270, so as to release the holding state in which the opening-and-closing cover 240 is held by the elastic holding part 271.

<Operation Flow for Insertion and Removal of Developer Storage Container>

Next, the operation flow for insertion and removal of the developer storage container will be described with reference to FIGS. 19 to 21. In FIGS. 19 to 21, in order to show the relative positional relationship between the container receiving portion 100 and the developer storage container 38, the developer storage container 38 is drawn as if it is transparent.

(1) Operation Flow For Insertion of Developer Storage Container (FIGS. 19 and 20)

The shutter 230 operates as follows when the developer storage container 38 is inserted into the container receiving portion 100.

Figure 19A:
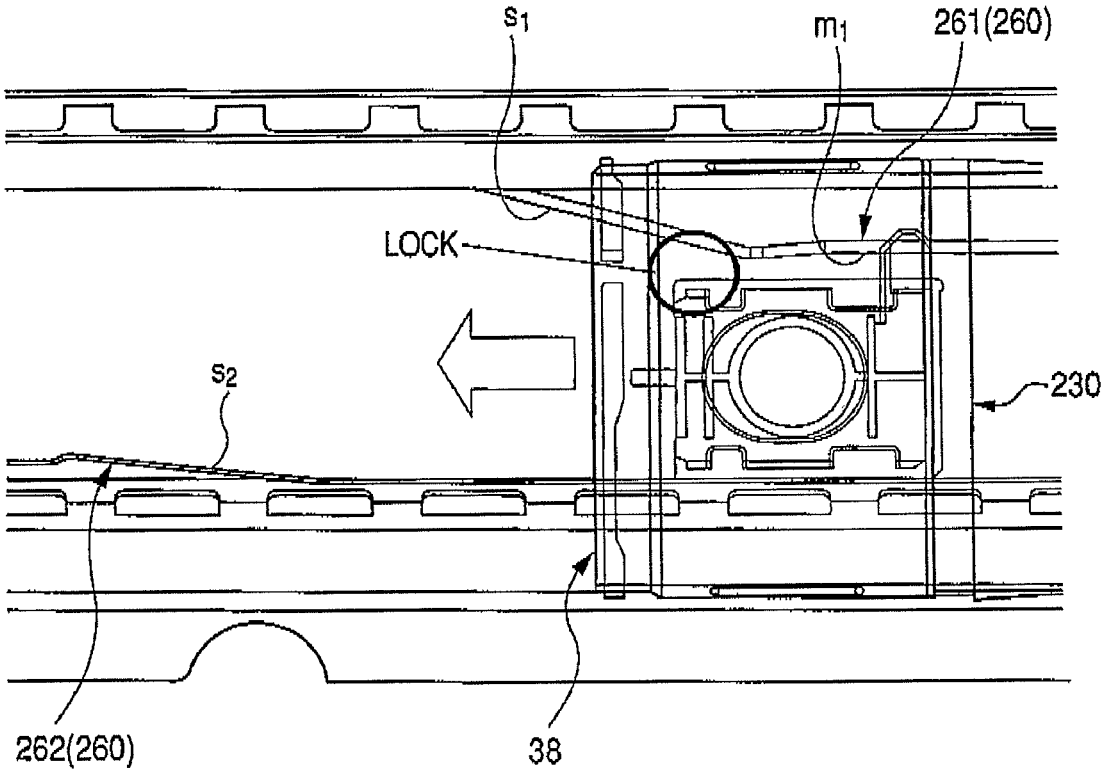
FIGS. 19A and 19B are explanatory diagrams showing an operation flow (1) when the developer storage container is inserted into the container receiving portion of the first exemplary embodiment.
Figure 19B:
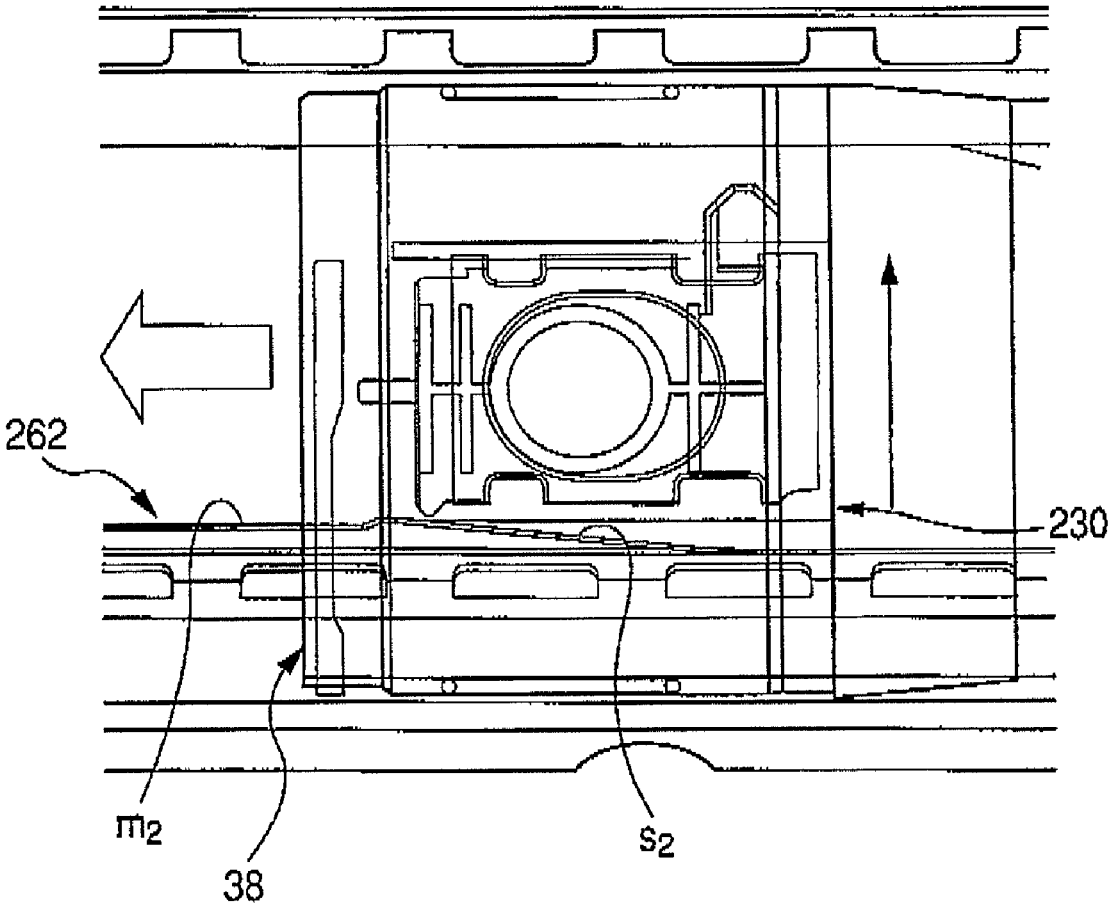
Figure 20A:
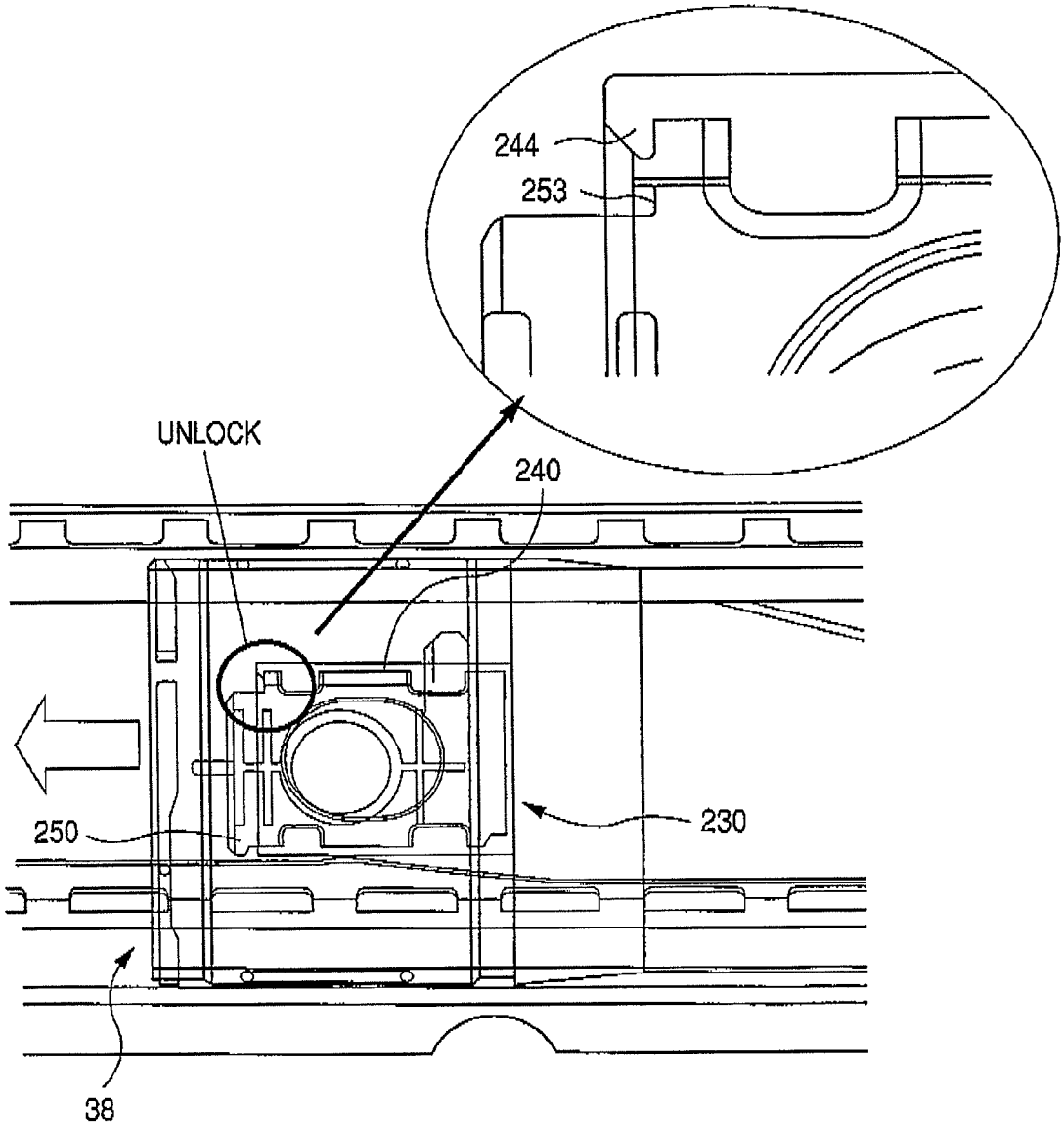
FIGS. 20A and 20B are explanatory diagrams showing an operation flow (2) when the developer storage container is inserted into the container receiving portion of the first exemplary embodiment.
Figure 20B:
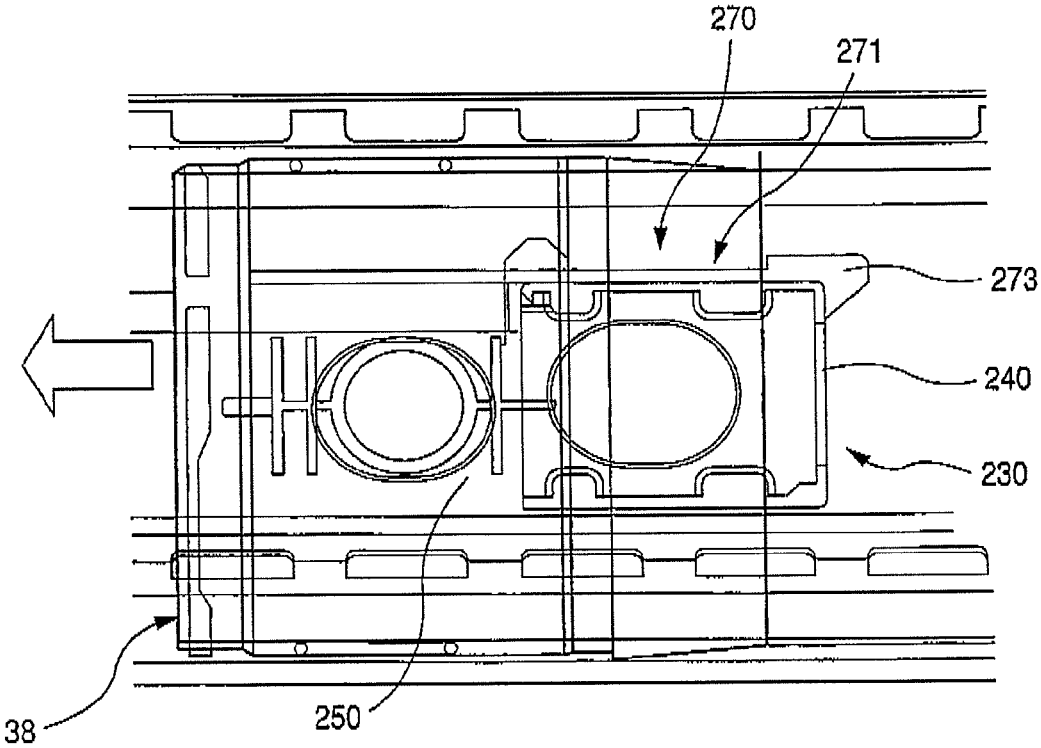

First, the opening-and-closing cover 240 in the closing position A moves while being guided by the cover guide rail 260 (261 and 262), to the intermediate position B in which the opening-and-closing cover 240 enters the unlock state via the lock state as shown in FIGS. 19A, 19B, and 20A. Subsequently, as shown in FIGS. 20A and 20B, the opening-and-closing cover 240 is moved to the opening position D by the elastic holding part 271 of the movable cover holding mechanism 270. Thereafter, the opening-and-closing cover 240 continues moving while pushing the elastic holding part 271 outward until it is held by the elastic holding part 271.

In the meantime, a user in only required to insert the developer storage container 38 into the container receiving portion 100 in the insertion/removal direction. In particular, in this exemplary embodiment, since the insertion/removal direction of the developer storage container is identical to the opening-and-closing direction of the shutter 230, the user need not pay attention to the opening/closing operation of the shutter 230 and the shutter 230 can be set to the opening position D by completing the insertion of the developer storage container 38 into the container receiving portion 100. As a result, the developer is sequentially supplied to the reserve tank 110 from the discharge opening 220 of the developer storage container 38.

(2) Operation Flow for Removal of Developer Storage Container (FIG. 21)

The shutter 230 operates as follows when the developer storage container 38 is removed from the container receiving portion 100.

Figure 21A:
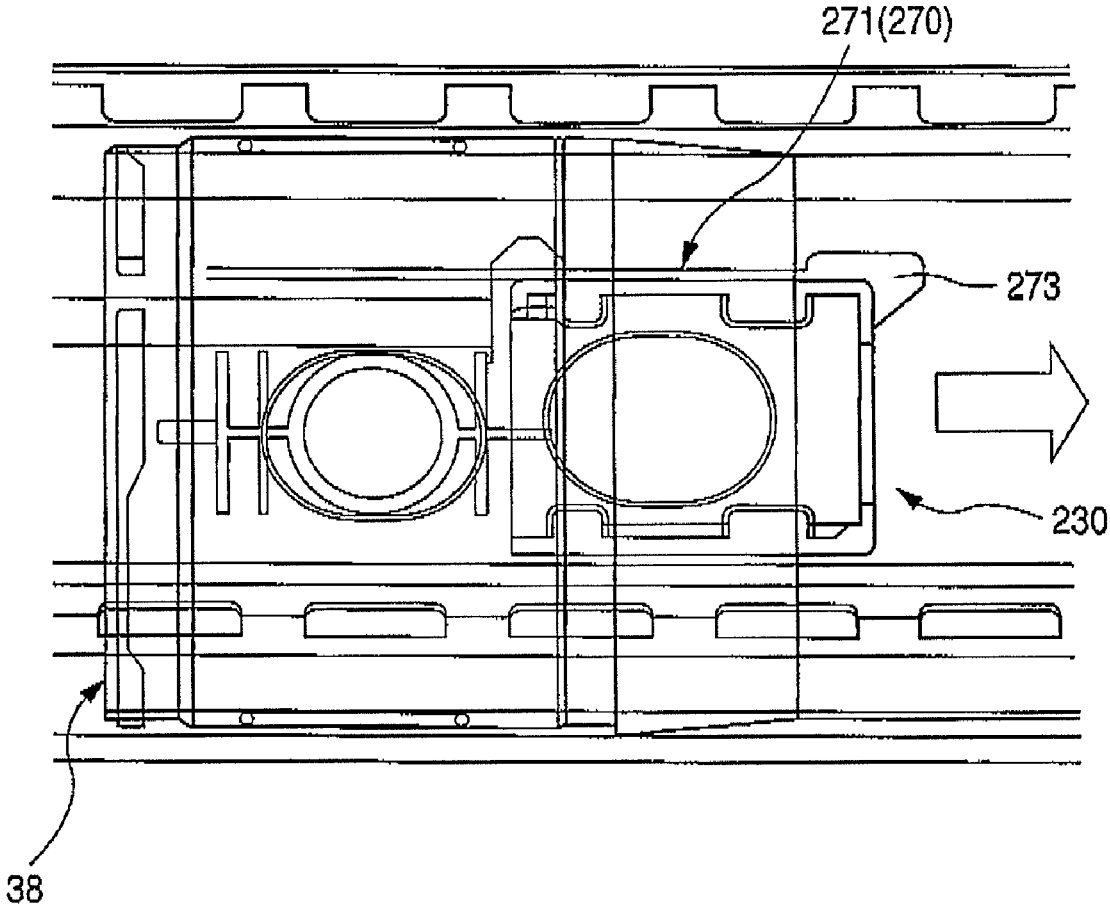
FIGS. 21A and 21B are explanatory diagrams showing an operation flow when the developer storage container is removed from the container receiving portion of the first exemplary embodiment.
Figure 21B:
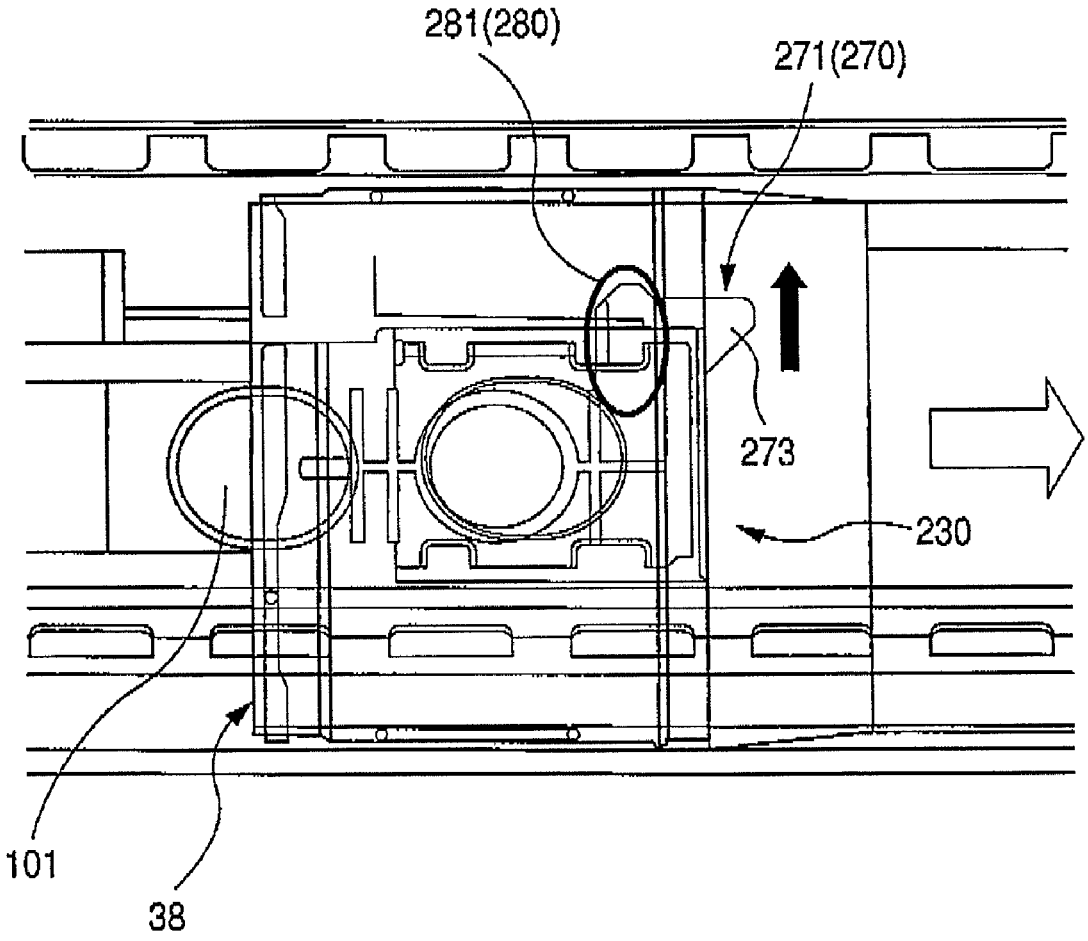

First, as shown in FIGS. 21A and 21B, the opening-and-closing cover 240 is moved to the closing position A by the elastic holding part 271. Thereafter, the holding state in which the opening-and-closing cover 240 is held by the elastic holding part 271 is released by the holding releasing protruding part 281. In such a state, the developer storage container 38 is removed from the container receiving portion 100 in a state where the shutter 230 is located in the closing position A.

What is claimed is:

1. A developer storage container that is removably inserted into a container receiving portion of a chassis of an image forming apparatus, the container that stores a developer therein, the container comprising:

a container body that stores the developer therein;

an opening formed in a portion of the container body;

an opening-and-closing cover configured to block the opening;

a cover holding frame that holds the opening-and-closing cover so that the opening-and-closing cover is movable in an opening-and-closing direction between an opening position in which the opening is open and a closing position in which the opening is closed;

a protrusion portion that is formed in the opening-and-closing cover, and protrudes toward the cover holding frame when the opening-and-closing cover is located in the closing position;

a blocking portion that is provided on the cover holding frame, wherein the blocking portion is disposed in a position that is overlapped, along the opening-and-closing direction of the opening-and-closing cover, with a position of a distal end of the protrusion portion when the opening-and-closing cover is located in the closing position, and when the opening-and-closing cover moves in the opening-and-closing direction from the closing position toward the opening position and reaches a certain intermediate position in which it is not started to open the opening, the blocking portion is in contact with the protrusion portion and is blocked; and a position regulating protrusion that is provided in the cover holding frame, wherein when the opening-and-closing cover moves from a position where the protrusion portion and the blocking portion are in contact with each other to the closing position, the position regulating protrusion causes the opening-and-closing cover to move in a direction intersecting the opening-and-closing direction and regulates a position of the opening-and-closing cover in the direction intersecting the opening-and-closing direction so that the blocking portion is overlapped, along the opening-and-closing direction, with the position of the distal end of the protrusion portion, wherein the opening-and-closing direction extends along an insertion/removal direction of the developer storage container.

2. The developer storage container according to claim 1, wherein a width direction is a direction that is perpendicular to the opening-and-closing direction of the opening-and-closing cover, and the following conditional expressions are satisfied:

$$f > w5 - w2$$

$$h > w6 - w1$$

$$k > w5 - w3$$

where w1 denotes the maximum width of the cover holding frame up to a distal end of the position regulating protrusion, w2 denotes a width of the cover holding frame from the distal end of the position regulating protrusion to the blocking portion, w3 denotes a width of the cover holding frame between the both sides excluding the position regulating protrusion, w4 denotes a width of the cover holding frame from one side thereof to the blocking portion excluding the position regulating protrusion, w5 denotes a width of the opening-and-closing cover from an inner surface of one of side walls thereof in the width direction to the protrusion portion, w6 denotes the maximum width of the opening-and-closing cover between the both side walls in the width direction excluding the protrusion portion, f denotes a blocking length of the blocking portion, h denotes a protrusion length of the protrusion portion, and k denotes a protrusion length of the position regulating protrusion.

3. An image forming apparatus comprising:

a chassis formed with a container receiving portion; and a developer storage container configured to be removably inserted into the container receiving portion of the chassis, the developer storage container that stores a developer therein, wherein the developer storage container includes a container body that stores the developer therein, an opening formed in a portion of the container body, an opening-and-closing cover configured to block the opening, a cover holding frame that holds the opening-and-closing cover so that the opening-and-closing cover is movable in an opening-and-closing direction between an opening position where the opening is open and a closing position where the opening is closed, a protrusion portion that is formed in the opening-and-closing cover, and protrudes toward the cover holding frame when the opening-and-closing cover is located in the closing position, a blocking portion that is provided on the cover holding frame, wherein the blocking portion is disposed in a position that is overlapped, along the opening-and-closing direction of the opening-and-closing cover, with a position of a distal end of the protrusion portion when the opening-and-closing cover is located in the closing position, and when the opening-and-closing cover moves in the opening-and-closing direction from the closing position toward the opening position and reaches a certain intermediate position in which it is not started to open the opening, the blocking portion is in contact with the protrusion portion and is blocked, and a position regulating protrusion that is provided in the cover holding frame, wherein when the opening-and-closing cover moves from a position where the protrusion portion and the blocking portion are in contact with each other to the closing position, the position regulating protrusion causes the opening-and-closing cover to move in a direction intersecting the opening-and-closing direction and regulates a position of the opening-and-closing cover in the direction intersecting the opening-and-closing direction so that the blocking portion is overlapped, along the opening-and-closing direction, with the position of the distal end of the protrusion portion, the container receiving portion of the chassis of the image forming apparatus includes a cover guide rail that guides the opening-and-closing cover of the developer storage container, a cover holding mechanism, and a cover-holding releasing mechanism, when the developer storage container is being inserted, the cover holding mechanism abuts against the opening-and-closing cover to move the opening-and-closing cover toward the opening position and then holds the opening-and-closing cover, when the developer storage container is being removed, the cover holding mechanism moves the opening-and-closing cover, which is located in the opening position, toward the closing position, and when the developer storage container is being removed and the opening-and-closing cover reaches the closing position, the cover-holding releasing mechanism releases a state in which the cover holding mechanism holds the opening-and-closing cover, wherein the opening-and-closing direction extends along an insertion/removal direction of the developer storage container.

4. The image forming apparatus according to claim 3, wherein the cover holding mechanism includes an elastic holding part that extends in the opening-and-closing direction of the opening-and-closing cover and is elastically deformable, and when the developer storage container is being inserted, the elastic holding part abuts against the opening-and-closing cover to move the opening-and-closing cover to the opening position and the elastic holding part is elastically deformed outward at a time point when the opening-and-closing cover reaches the opening position, so as to be displaced from the opening-and-closing cover and then hold the opening-and-closing cover being located in the opening position.

5. The image forming apparatus according to claim 4, wherein the cover-holding releasing mechanism includes a holding releasing protruding part that is elastically deformed in the direction for displacing the elastic holding part from the opening-and-closing cover when the opening-and-closing cover reaches the closing position, and the holding releasing protruding part releases the state in which the elastic holding part holds the opening-and-closing cover.

* * * * *